US006264344B1

(12) United States Patent
Quiogue et al.

(10) Patent No.: US 6,264,344 B1
(45) Date of Patent: Jul. 24, 2001

(54) CANOPY LUMINAIRE ASSEMBLY

(75) Inventors: Honesto D. Quiogue, Florence, KY (US); Thomas E. Kuhlmann, Cincinnati, OH (US); Norman Schuler, West Chester, OH (US); Chris Cicenas, Columbus, OH (US)

(73) Assignee: Spaulding Lighting, Inc., Cincinnati, OH (US)

( * ) Notice: Subject to any disclaimer, the term of this patent is extended or adjusted under 35 U.S.C. 154(b) by 0 days.

(21) Appl. No.: 09/466,074

(22) Filed: Dec. 17, 1999

Related U.S. Application Data

(63) Continuation of application No. 09/089,214, filed on Jun. 3, 1998, now Pat. No. 6,116,749.

(51) Int. Cl.[7] ..... F21S 8/00

(52) U.S. Cl. ..... 362/147; 362/148; 362/457; 362/458; 362/365; 362/265; 362/263; 362/370; 362/152

(58) Field of Search ..... 362/102, 152, 362/147, 148, 370, 365, 366, 265, 263, 221

(56) References Cited

U.S. PATENT DOCUMENTS

| | | |
|---|---|---|
| D. 24,496 | 7/1895 | Keeler et al. . |
| D. 24,498 | 7/1895 | Keeler et al. . |
| D. 38,972 | 12/1907 | Goehst . |

(List continued on next page.)

FOREIGN PATENT DOCUMENTS

| | | |
|---|---|---|
| 221660 | 6/1962 | (AT) . |
| 539841 | 4/1957 | (CA) . |
| 641278 | 5/1962 | (CA) . |
| 232932 | 3/1910 | (DE) . |
| 387888 | 5/1923 | (DE) . |
| 434355 | 7/1924 | (DE) . |
| DAS 1100166 | 2/1961 | (DE) . |
| 4002-589-A | 9/1990 | (DE) . |
| 4016-531-A | 11/1991 | (DE) . |
| 4139521 | 6/1993 | (DE) . |
| 1176345 | 11/1958 | (FR) . |
| 339818 | 12/1930 | (GB) . |
| 806124 | 12/1958 | (GB) . |
| 1083617 | 9/1967 | (GB) . |
| 3167705 | 7/1991 | (JP) . |
| 5-242715(A) | 9/1993 | (JP) . |
| 185489 | 10/1963 | (SE) . |

OTHER PUBLICATIONS

"The Scottsdale SuperKit," brochure, LSI, 1998.
"The Scottsdale RIC SuperKit," , brochure, LSI, 1998.
"The New Generation Scottsdale" brochure, LSI, 1998.

(List continued on next page.)

*Primary Examiner*—Sandra O'Shea
*Assistant Examiner*—Ali Alavi
(74) *Attorney, Agent, or Firm*—Hunton & Williams

(57) ABSTRACT

A luminaire assembly comprises a lower portion for receiving a light emitting source and an upper housing that stores the electrical components of the luminaire. The lower portion has a base portion disposed against the canopy with a latch attachment portion, a lens secured to the base portion by a hinge mechanism that permits the lens to open with respect to the base portion, and a latch connected to the base portion and having a connecting portion for connecting the base portion to the lens. The upper housing is disposed above the canopy. A bracket is attached to the base portion and extends up through the aperture in the canopy and connects to an inner wall of an apertured portion of the upper housing to secure the lower portion to the upper housing. The upper housing may have extending deck supports to support the weight of the upper housing on the ribs of the canopy. A locking cam is provided to secure the bracket to the upper housing. The upper housing has a slot having an inner wall, an outer wall, and a gap disposed between the inner and outer walls so that a conduit having a stop at the connecting end may slid into the slot with a gasket disposed thereon to fill up the gap and provide a secure, sealed tool-less attachment of the conduit.

20 Claims, 37 Drawing Sheets

U.S. PATENT DOCUMENTS

| | | | |
|---|---|---|---|
| D. 147,093 | 7/1947 | Vorsanger | D48/23 |
| D. 170,084 | 7/1953 | Glatthar et al. . | |
| D. 186,185 | 9/1959 | Benjamin | D48/16 |
| D. 232,376 | 8/1974 | Yahraus et al. . | |
| D. 249,291 | 9/1978 | Pemberton . | |
| D. 262,914 | 2/1982 | Kristofek | D26/135 |
| D. 286,579 | 11/1986 | Pugh et al. . | |
| D. 301,628 | 6/1989 | Fuller . | |
| D. 304,092 | 10/1989 | Glassman | D26/85 |
| D. 312,842 | 12/1990 | Younger et al. | D20/42 |
| D. 315,216 | 3/1991 | Kelley et al. | D26/28 |
| D. 321,406 | 11/1991 | Schlesselman . | |
| D. 324,113 | 2/1992 | Morrison . | |
| D. 343,015 | 1/1994 | Yuen . | |
| D. 352,797 | 11/1994 | Mehaffey . | |
| D. 356,169 | 3/1995 | Lyons . | |
| D. 375,180 | 10/1996 | Lyons | D26/28 |
| D. 375,379 | 11/1996 | DiCola et al. . | |
| D. 377,841 | 2/1997 | Vakil | D26/85 |
| D. 377,991 | 2/1997 | Vakil | D26/85 |
| 1,248,187 | 11/1917 | Smith . | |
| 1,573,580 | 2/1926 | Ruttle . | |
| 1,588,222 | 6/1926 | Olier, Jr. . | |
| 1,595,972 | 8/1926 | Reamer . | |
| 1,683,599 | 9/1928 | Berry . | |
| 1,686,663 | 10/1928 | Holmes . | |
| 1,775,768 | 9/1930 | Kenerson . | |
| 1,931,343 | 10/1933 | Cook et al. | 240/78 |
| 2,007,528 | 7/1935 | Graham . | |
| 2,179,161 | 11/1939 | Rambusch et al. | 240/78 |
| 2,225,057 | 12/1940 | Kuntz . | |
| 2,225,217 | 12/1940 | Hicok . | |
| 2,227,655 | 1/1941 | Levy | 240/78 |
| 2,463,046 | 3/1949 | Naysmith . | |
| 2,534,992 | 12/1950 | Reid . | |
| 2,630,522 | 3/1953 | MacDougall | 240/78 |
| 2,636,978 | 4/1953 | Williamson | 240/78 |
| 2,639,368 | 5/1953 | Pryne | 240/78 |
| 2,700,751 | 1/1955 | Hallerberg . | |
| 2,712,120 | 6/1955 | Cochran . | |
| 2,744,716 | 5/1956 | Zingone . | |
| 2,791,681 | 5/1957 | Dunker et al. | 240/51.11 |
| 2,899,542 | 8/1959 | De Mauro . | |
| 2,954,201 | 9/1960 | Pascucci et al. . | |
| 2,961,530 | 11/1960 | Stahlhut et al. | 240/73 |
| 2,965,348 | 12/1960 | Gerstel et al. . | |
| 2,971,670 | 2/1961 | McCormack . | |
| 2,975,271 | 3/1961 | Dvorak . | |
| 2,998,510 | 8/1961 | Versen . | |
| 2,998,511 | 8/1961 | Chan | 240/78 |
| 3,012,133 | 12/1961 | Archer . | |
| 3,037,110 | 5/1962 | Williams . | |
| 3,064,851 | 11/1962 | Guigli | 220/18 |
| 3,069,541 | 12/1962 | Thomsen et al. . | |
| 3,070,691 | 12/1962 | Relich | 240/147 |
| 3,096,029 | 7/1963 | Berge | 240/25 |
| 3,130,949 | 4/1964 | Erhardt et al. . | |
| 3,156,419 | 11/1964 | Wince | 241/16 |
| 3,158,329 | 11/1964 | Wince . | |
| 3,176,255 | 3/1965 | Jensen . | |
| 3,294,967 | 12/1966 | Pascucci | 240/78 |
| 3,315,074 | 4/1967 | Buzan et al. | 240/147 |
| 3,353,015 | 11/1967 | Franklin et al. . | |
| 3,370,165 | 2/1968 | Chan . | |
| 3,375,368 | 3/1968 | Dorsky . | |
| 3,387,255 | 6/1968 | Earleywine, Jr. . | |
| 3,431,003 | 3/1969 | Bacon, Jr. et al. | 292/256 |
| 3,488,626 | 1/1970 | Koerper et al. . | |
| 3,511,982 | 5/1970 | Salter . | |
| 3,518,420 | 6/1970 | Kripp . | |
| 3,604,921 | 9/1971 | Wood et al. | 240/25 |
| 3,654,453 | 4/1972 | Jablonski . | |
| 3,671,739 | 6/1972 | McCain . | |
| 3,675,007 | 7/1972 | Appleton et al. . | |
| 3,697,742 | 10/1972 | Bobrick . | |
| 3,705,300 | 12/1972 | Plemmons et al. | 240/25 |
| 3,720,432 | 3/1973 | Chudler . | |
| 3,745,327 | 7/1973 | Lowery et al. | 240/9 R |
| 3,755,667 | 8/1973 | Price . | |
| 3,836,766 | 9/1974 | Auerbach | 240/73 |
| 3,872,296 | 3/1975 | Cohen et al. . | |
| 3,883,732 | 5/1975 | Peterson et al. . | |
| 3,900,725 | 8/1975 | Komon . | |
| 3,983,387 | 9/1976 | Van Steenhoven et al. | 240/147 |
| 4,025,782 | 5/1977 | Kaeser . | |
| 4,031,382 | 6/1977 | Laughter | 240/25 |
| 4,071,749 | 1/1978 | Balogh . | |
| 4,091,444 | 5/1978 | Mori . | |
| 4,141,061 | 2/1979 | Ford et al. . | |
| 4,161,019 | 7/1979 | Mulvey . | |
| 4,186,433 | 1/1980 | Baldwin | 362/263 |
| 4,200,905 | 4/1980 | Shelby et al. | 362/396 |
| 4,232,361 | 11/1980 | Kelsall . | |
| 4,250,540 | 2/1981 | Kristofek . | |
| 4,255,781 | 3/1981 | Plemmons et al. . | |
| 4,262,326 | 4/1981 | Lewin | 362/223 |
| 4,274,615 | 6/1981 | Chan et al. . | |
| 4,281,370 | 7/1981 | Massenheimer et al. | 362/287 |
| 4,285,034 | 8/1981 | Sullivan | 362/305 |
| 4,293,895 | 10/1981 | Kristofek . | |
| 4,298,919 | 11/1981 | Karasawa . | |
| 4,302,798 | 11/1981 | Sit . | |
| 4,313,153 | 1/1982 | Davis | 362/184 |
| 4,315,302 | 2/1982 | Petralia . | |
| 4,326,243 | 4/1982 | Pistor et al. | 362/368 |
| 4,327,403 | 4/1982 | Capostagno et al. . | |
| 4,336,575 | 6/1982 | Gilman . | |
| 4,384,316 | 5/1983 | de Vos et al. . | |
| 4,388,674 | 6/1983 | Sano . | |
| 4,403,278 | 9/1983 | Flood . | |
| 4,408,262 | 10/1983 | Kusmer . | |
| 4,419,717 | 12/1983 | Price et al. . | |
| 4,422,134 | 12/1983 | Brass | 362/300 |
| 4,449,168 | 5/1984 | Ewing | 362/404 |
| 4,459,648 | 7/1984 | Ullman . | |
| 4,460,948 | 7/1984 | Malola . | |
| 4,472,767 | 9/1984 | Wenman | 362/302 |
| 4,490,778 | 12/1984 | Collins et al. . | |
| 4,512,098 | 4/1985 | Ready et al. . | |
| 4,514,792 | 4/1985 | Klaus | 362/294 |
| 4,516,196 | 5/1985 | Blake . | |
| 4,518,896 | 5/1985 | Miles, Jr. . | |
| 4,540,436 | 9/1985 | Wolfsgruber et al. | 75/130 |
| 4,547,840 | 10/1985 | Tinder . | |
| 4,633,377 | 12/1986 | Mackiewicz | 362/309 |
| 4,636,924 | 1/1987 | Targetti . | |
| 4,654,768 | 3/1987 | Dryman et al. . | |
| 4,703,406 | 10/1987 | Elliott et al. . | |
| 4,704,665 | 11/1987 | Grindle | 362/267 |
| 4,713,916 | 12/1987 | Brooks, Jr. | 52/39 |
| 4,716,504 | 12/1987 | Pahl et al. . | |
| 4,739,460 | 4/1988 | Kelsall . | |
| 4,748,543 | 5/1988 | Swarens . | |
| 4,754,383 | 6/1988 | Klaus . | |
| 4,760,510 | 7/1988 | Lahti . | |
| 4,763,231 | 8/1988 | Houplain . | |
| 4,809,468 | 3/1989 | Bareiss . | |
| 4,827,386 | 5/1989 | Mackiewicz . | |
| 4,837,669 | 6/1989 | Tharp et al. . | |
| 4,870,549 | 9/1989 | Lauckhardt et al. . | |
| 4,885,665 | 12/1989 | Birillo . | |

| | | | |
|---|---|---|---|
| 4,910,650 | 3/1990 | Goralnik . | |
| 4,974,137 | 11/1990 | Evan, Jr. et al. | 362/300 |
| 4,999,757 | 3/1991 | Poppenheimer . | |
| 5,034,869 | 7/1991 | Choi . | |
| 5,045,984 | 9/1991 | Trowbridge et al. . | |
| 5,057,979 | 10/1991 | Carson et al. . | |
| 5,068,772 | 11/1991 | Shapiro et al. . | |
| 5,081,569 | 1/1992 | Quiogue et al. | 362/328 |
| 5,083,248 | 1/1992 | Troy . | |
| 5,122,944 | 6/1992 | Webb . | |
| 5,136,490 | 8/1992 | Morrison . | |
| 5,161,878 | 11/1992 | Degelmann et al. . | |
| 5,163,749 | 11/1992 | Wu . | |
| 5,172,976 | 12/1992 | Bogdanovs | 362/374 |
| 5,174,642 | 12/1992 | Brohard et al. . | |
| 5,174,648 | 12/1992 | Clary et al. . | |
| 5,222,800 | 6/1993 | Chan et al. . | |
| 5,228,773 | 7/1993 | Win . | |
| 5,272,605 | 12/1993 | Johnstone . | |
| 5,289,358 | 2/1994 | Halemeier . | |
| 5,309,342 | 5/1994 | Heinen, Sr. . | |
| 5,331,531 | 7/1994 | Unger et al. . | |
| 5,349,513 | 9/1994 | Taylor, III . | |
| 5,373,431 | 12/1994 | Hayman et al. . | |
| 5,374,812 | 12/1994 | Chan et al. . | |
| 5,376,020 | 12/1994 | Jones . | |
| 5,377,088 | 12/1994 | Lecluze . | |
| 5,379,199 | 1/1995 | Hirshenhorn et al. . | |
| 5,381,320 | 1/1995 | Jordan . | |
| 5,428,515 | 6/1995 | Jung . | |
| 5,440,471 | 8/1995 | Zadeh | 362/365 |
| 5,461,550 | 10/1995 | Johnstone . | |
| 5,463,540 | 10/1995 | Jones . | |
| 5,486,989 | 1/1996 | Compton | 362/291 |
| 5,491,618 | 2/1996 | Vakil . | |
| 5,537,304 | 7/1996 | Klaus | 362/373 |
| 5,548,499 | 8/1996 | Zadeh . | |
| 5,560,707 | 10/1996 | Neer . | |
| 5,562,341 | 10/1996 | Strauss . | |
| 5,562,343 | 10/1996 | Chan et al. . | |
| 5,564,820 | 10/1996 | Entrop et al. | 362/362 |
| 5,567,041 | 10/1996 | Slocum . | |
| 5,574,600 | 11/1996 | Agro . | |
| 5,597,233 | 1/1997 | Lau | 362/294 |
| 5,599,094 | 2/1997 | Fischer et al. . | |
| 5,609,414 | 3/1997 | Caluori . | |
| 5,636,463 | 6/1997 | Sharon et al. . | |
| 5,662,407 * | 9/1997 | Fischer et al. | 362/147 |
| 5,662,413 | 9/1997 | Akiyama | 362/365 |
| 5,738,436 | 4/1998 | Cummings et al. | 362/294 |
| 5,758,959 | 6/1998 | Sieczkowski | 362/365 |
| 5,797,721 | 8/1998 | Yu | 415/5 |
| 5,820,252 | 10/1998 | Finch | 362/265 |
| 5,826,970 | 10/1998 | Keller et al. | 362/147 |
| 5,927,843 | 7/1999 | Haugaard et al. | 362/147 |
| 5,957,565 | 9/1999 | Hofmann | 362/147 |
| 5,975,477 | 11/1999 | Spitler | 248/342 |
| 5,997,158 | 12/1999 | Fischer et al. | 362/374 |
| 6,022,129 | 2/2000 | Tang | 362/404 |
| 6,030,102 | 2/2000 | Gromotka | 362/365 |
| 6,042,251 | 3/2000 | McCarthy et al. | 362/308 |
| 6,059,422 | 5/2000 | Fischer et al. | 362/147 |
| 6,082,871 | 7/2000 | Yeh | 362/147 |
| 6,086,226 | 7/2000 | Chang | 362/294 |

OTHER PUBLICATIONS

"Installation and Assembly Instructions" for the Scottsdale Series, 11/97.

*Dropped Borosilicate Prismatic Glass Lens*, Whiteway of Cincinnati, OH, P. B5a, 09/97.

Sales Brochure, Hubbell Lighting, Inc., "Parimaliter® II Glass—PGM Series", p. 439.

Sales Brochure, Cooper Lighting, "Lumark®" QF Quadra–Lume, p. 337.

Sales Brochure, Cooper Lighting, "Lumark®" RY Roadway Cobrahead; p. 343.

Sales Brochure, Caprii® Lighting, Recessed Fluorescent, p. C–31.

Sales Brochure, Industrial Lighting, GE Lighting Systems UniGlow® 400/1000 Luminaire; Jan. 1997, p. 38.

Sales Brochure, Roadway Lighting, GE Lighting Systems, VersaFlood II Signiliter, Jan. 1997, p. 290.

Sales Brochure, Roadway Lighting; GE Lighting Systems; "Turnpike Luminaire™"; Jan. 1997; p. 292.

Sales Brochure, Industrial Lighting; GE Lighting Systems, Minimount® Luminaire; Jan. 1997; p. 84.

Sales Brochure, Lithonia Lighting; "2' x 2" General Area Lighting, Lensed Refractor; p. 311.

Sales Brochure, Incadescent LA Series; "Square Lens"; p. 131.

Sales Brochure, Lithonia Lighting; "Wall–Mounted Area Lighter, Glass Refractor"; p. 266.

Sales Brochure; Visa Lighting.

Sales Brochure, L20™ and L21™ Series; LLCYL ™ Cylinder Series; CAND™ Candela Series.

Sales Brochure BEGA, pp. 3, 5, 7, 13, 15, 17, 23, 25, 27, 37, 43.

Sales Brochure Prescolite; pp. 181, 243.

Sales Brochures, KIM Lighting "Path or Border Lights" pp. C2–12; "Pathlighters" pp. C2–14.

Sales Brochure, Holophane, p. 28, 53, 55, 68, 86, 99, 118, 133, 135, 137, 148, 152, 173.

Sales Brochure KIM Lighting, "Features"; p. 4.

Sales Brochure, Refractor Information; Sterner, p. 10.

Sales Brochure KIM Lighting, "Specifications: Fixtures"; p. 13.

Sales Brochure, Blackrock® Series 415.

Sales Brochure; Hubbell Lighting, Inc. "Enclosed and Gasketed—Kemlux® II KH Series" p. 323.

Sales Brochure, GCV Series '12" Square HID Ceiling Mount; p. 1–2.

Sales Brochure Cooper Lighting LUMARK® Parking Garage; pp. 1–2.

Sales Brochure Kennall Manufacturing: "Kenall® Lighting for Tough Environments" Paragon pp. 1–2.

Sales Brochure Architectural Area Lighting "ALR 156 Nautical".

Sales Brochure RV Series METROLUX® Roadway Lighting Solutions "Ceiling Mounted Luminaires"; pp. 2–4.

Sales Brochure; Hubbell Lighting, Inc. Perimamite™; p. 435.

Sales Brochure, Hubbell Lighting, Inc.; "Perimapak™ Series"; p. 436.

Sales Brochure, Quality Lighting; "Design CB".

Sales Brochure, Quality Lighting; "Design DL" p. 6.

Sales Brochure "JUNO".

Sales Brochure, WLM Medium Wall Light; "Day–Brite" p. H65.

Sales Brochure; HBY Industra I Open/Enclosed 400; "Day–Brie HBY Industra I Open/Enclosed 400" p. H17.

Sales Brochure; Metrolux™ " SV Series Ceiling Mounted Luminaires"; pp. 2–4.

Sales Brochure; Metrolux™ " RV Series Ceiling Mounted Luminaires"; pp. 2–4.

Sales Brochure KIM Lighting; "Wall Forms™ Cast Aluminum" pp. 20–21.
Sales Brochure, HID Lighting Fixtures; "Metal Halide" p. 1.
Sales Brochure, KIM Lighting "Permanence" p. 4.
Sales Brochure KIM Lighting, "Uncompromised Quality" p. 8.
Sales Brochure KIM Lighting; p. 10.
Sales Brochure Guth Lighting: Outdoor; p. 1.
Sales Brochure Incandescent Vapolet Day–Brite® Incandescent; p. F–98.
Sales Brochure Cooper Lighting Lumark®; WL WAL–PAK; p. 35.
Sales Brochure Devine Lighting; Steplights LMS400/LMS500/LMS600; p. D1–2.
Sales Brochure Devine Lighting; Wallpack/Security B275/B280/B380/B300; p. E3–4.
Sales Brochure Devine Lighting "Downlights/Round & Square D420/D450 Series"; p. F1–1.
Sales Brochure Devine Lighting "Downlights/Round & Square E540/E551 Series"; p. F1–2.
Sales Brochure Metrolux® Roadway Lighting Solutions "RV Series Ceiling Mounted Luminaires"; pp. 1–2.
Sales Brochure Devine Lighting; Accent Surface/Wall Mount TRG Series; p. E1–5; CCG Series; pp. E1–4.
Silvray–Litecraft Corporation, catalog cut sheet of Sect. D, Surface Mounted and Semi–Recessed Incandescent Units, 1 pg.
Omega Lighting, Inc. catalog cut sheet of light fixture model H842, multi–purpose downlites, 2 pgs.
Curtis Lighting, Inc. Recessed Lighting Equipment Brochure, 1938, pp. XR–104, XR–108–111, XR–119.
Electric Light on the Farm and in the Rural Districs, Lighting Data (Bulletin LD) p. 153A,& p. 14.
Swivelier's Sensationally New *Gyro–Lite* light fixture cut sheet, 1 pg.
McPhilben Lighting Design catalog cut sheet for *Mercury Vapro Incandescent or Quartz–halogen Recessed or Semi–recessed Downlights*, p. SEC.AA 220, 220.3.
Devine Lighting catalog cut sheets, for light fixture model D1–16, Semi–Recessed Square, D1–17, *Semi–Recessed Square Concrete Pour*, D2–18, *Semi–Recessed Round Concrete Pour*, D2–17, *Semi–Recessed Round*, 1986.
American Lighting Corp. catalog cut sheet for *Mini–Groove Baffle Downlight, Semi–Recessed and Mini–Groove Baffle Downlight*, & *Adjustable Recessed Lighting*, 4 pgs.
Microflector Co., Inc catalog cut sheets,. *Illumination Amplifiers*,for Slip and Screw type fixtures.
Microflector Co., Inc. catalog cut sheets for Series C3000: Reflectors Lamp Downlights—Cones and Microgrooves, 6 pgs.
Waugh, "SPDT Switch Serves PCN Applications", Jan. 1994, Microwaves & RF.

* cited by examiner

CANOPY LUMINAIRE ASSEMBLY

PRIOR APPLICATION

This application is a continuation of U.S. application Ser. No. 09/089,214 filed on Jun. 3, 1998 U.S. Pat. No. 6,116,749, having the title "Canopy Luminaire Assembly." This application is also related to U.S. Des. Pat. No. 405,207 filed on Jun. 3, 1998.

FIELD OF THE INVENTION

This invention relates to canopy luminaries, and more particularly to canopy luminaries mounted to a horizontal mounting member which may be mounted by one individual without requiring the use of tools.

BACKGROUND OF THE INVENTION

Canopy luminaire assemblies are used in many areas, such as for gas stations, restaurant drive-through windows, and other areas where over-head lighting is desirable. Such assemblies generally require control gear, such as ballast, capacitors, and starters, to regulate the lighting. A housing is used to hold and protect the control gear as well as the light source, and is generally mounted to the support structure.

To mount existing luminaires, an opening must be made in the canopy in which the luminaire is to be mounted. The opening must be sized to receive the housing. The luminaire is mounted to the horizontal portion of the support structure. Cutting an opening and installing the luminaire are labor intensive, which may require a number of electricians and tools, resulting in high costs for installation.

Current designs have the ballast located within the housing with other components of the luminaire, including the light source. As a result, the operation temperature of the ballast and the control gear is increased due to exposure to the light source. The useful life of the components is reduced, and the components must be replaced more often. This replacement would be expensive due to the high installation costs.

Another feature of existing luminaires is that the light source is often mounted within the mounting structure. This feature has the drawback that half of the light from the light source emanates upward, thereby degrading the amount of light from the luminaire. Although reflectors may be used to deflect some of the light emanating upward, a large portion of the light from the light source is lost.

Another drawback is that it is difficult to replace the light source in existing luminaires. The lens is generally connect by fasteners, such as screws or bolts. Thus, to change the light source, an individual must use a ladder to change the light source. While on the ladder, an individual must undue the fasteners, release the lens, replace the light source, and refasten the lens. This process can be cumbersome and time consuming.

These and other drawbacks exist.

SUMMARY OF THE INVENTION

An object of the invention is to overcome these and other drawbacks in existing devices.

Another object of the invention is to provide a canopy luminaire assembly, which provides a ballast housing that rest entirely on a canopy, while a lower portion, comprising the lighting components, is disposed on an opposite side of the canopy.

A further object of this invention is to provide a canopy luminaire assembly, where a ballast housing contains at least a socket on one side of a canopy, and a lower portion containing a reflector, a bulb, and a lens on the other side of the canopy, with the lighting fixture assembly operatively connected to the socket.

A further object of this invention is to provide a canopy luminaire assembly where a rotating locking cam is used to tighten draw clamp brackets which are attached to a lower portion, and which are disposed on the opposite side of the canopy from the lower portion.

A further object of this invention is to provide a canopy luminaire assembly where a hinge is located on a lens, thereby allowing a lower portion to be opened by an individual by pushing the latch to open a lens, and access a light source.

A further object of the invention is to provide a canopy luminaire assembly where a hinge is incorporated into the material of a lower portion, and more specifically, a lens.

A further object of the invention is to provide a canopy luminaire assembly, whereby the attachment of a lower portion and a ballast section permits rotation and orientation of the lower portion with respect to the ballast section.

A further object of the invention is to provide a canopy luminaire assembly, where draw clamp brackets which snap to ballast notches located within a ballast housing are used to temporarily retain a lower portion until a locking mechanism, such as a locking cam, may be used to permanently retain a lower portion to a ballast housing.

A further object is to provide a canopy luminaire assembly, where electrical wiring is connected to a ballast housing by way of a slot in a ballast housing, a conduit having a locking member, and a conduit gasket that slides into the slot in ballast housing.

A further object is to provide a canopy luminaire assembly, where an individual user can attach a ballast section and lower portion to a canopy without the aid of other individuals and without requiring any tools.

Accordingly, a canopy luminaire may be provided according to an embodiment of the present invention. The canopy luminaire may comprise a lower portion for receiving a light emitting source and an upper housing that stores the electrical components of the luminaire. The lower portion has a base portion disposed against the canopy with a latch attachment portion, a lens secured to a base portion by a hinge mechanism that permits the lens to open with respect to the base portion, and a latch connected to the base portion and having a connecting portion for connecting the base portion to the lens. The upper housing is disposed above the canopy. A bracket is attached to the base portion and extends up through an aperture in the canopy and connects to an inner wall of an apertured portion of the upper housing to secure the lower portion to the upper housing. The upper housing may have extending deck supports to support the weight of the upper housing on ribs of the canopy. A locking cam is provided to secure the bracket to the upper housing. The upper housing has a slot having an inner wall, an outer wall, and a gap disposed between the inner and outer walls so that a conduit having a stop at the connecting end may slide into the slot with a gasket disposed thereon to fill up the gap and provide a secure, sealed tool-less attachment of the conduit.

According to another embodiment of the present invention, a canopy luminaire assembly may comprise a lower portion disposed below the canopy for receiving a light emitting source and an upper housing disposed above the canopy having disposed therein a ballast and a lamp socket. The light emitting source from the lower portion extends up through an aperture in the canopy and connects to the lamp socket in the upper housing. An attachment mechanism is attached to the lower portion, extends up through the aperture in the canopy and connects to the upper housing.

According to another embodiment of the present invention, the canopy luminaire comprises a lower portion for receiving a light emitting source and an upper housing disposed above the canopy. The upper housing comprises an aperture disposed in the bottom portion formed by walls on the interior of the upper housing with the walls having a receiving portion for receiving a bracket portion. A bracket is connected to the lower portion and the upper housing, wherein the bracket comprises a portion that cooperates with the receiving portion in the upper housing to secure the bracket to the walls of the upper housing.

According to another embodiment, a canopy luminaire comprises a lower portion disposed below the canopy for receiving a light emitting source and an upper housing disposed above the canopy. An attachment mechanism attaches to the lower portion and the upper housing through the aperture in the canopy. The position where the attachment mechanism is secured to the lower housing is movable so that the orientation between the lower portion and the upper housing may be altered.

According to yet another embodiment of the present invention, the canopy luminaire assembly disposed below the canopy comprises a base portion disposed against the canopy with a latch attachment portion. A lens is secured to the base portion by a hinge mechanism that permits the lens to open with respect to the base portion. A latch is connected to the base portion and has a connecting portion for connecting the base portion to the lens.

According to another embodiment, a canopy luminaire assembly comprises a base portion secured to a ceiling, a glass lens that has a hinge boss as part of the glass lens, a hinge connected to the hinge boss on the lens and to the base portion to permit the lens to open with respect to the base portion, and a latch connecting the base portion to the hinge to retain the lens to the base portion.

According to still another embodiment of the present invention, a canopy luminaire comprises a housing for supporting one or more electrical lighting components having one or more wires. The housing comprises a slot having an inner wall, an outer wall, and a gap disposed between the inner and outer walls. A conduit for supplying wiring for the electrical connections has a stop at one end. A gasket is disposed around the end of the conduit. The end of the conduit, the stop and the gasket slide into the slot between the inner and outer wall to fill the gap disposed there between. A cover is then placed over the slot to enclose the gasket within the gap and thereby provide a sealed and secure connection of the conduit to the housing.

According to yet another embodiment of the present invention, a luminaire assembly comprises a base portion secured to a ceiling, a lens connected to the base portion, and a glass filled polyester bezel disposed around the edge of the lens to cover the upper portion of the lens and the base portion.

These and other objects of the invention will be described in further detail in the accompanying drawings and specification.

BRIEF DESCRIPTION OF THE DRAWINGS

FIG. 24(*b*) is a front view of spring according to one embodiment of the present invention.

FIG. 25(*b*) is a bottom view of a canopy luminaire lens according to one embodiment of the present invention.

DETAILED DESCRIPTION OF THE PREFERRED EMBODIMENTS

Figure 1:
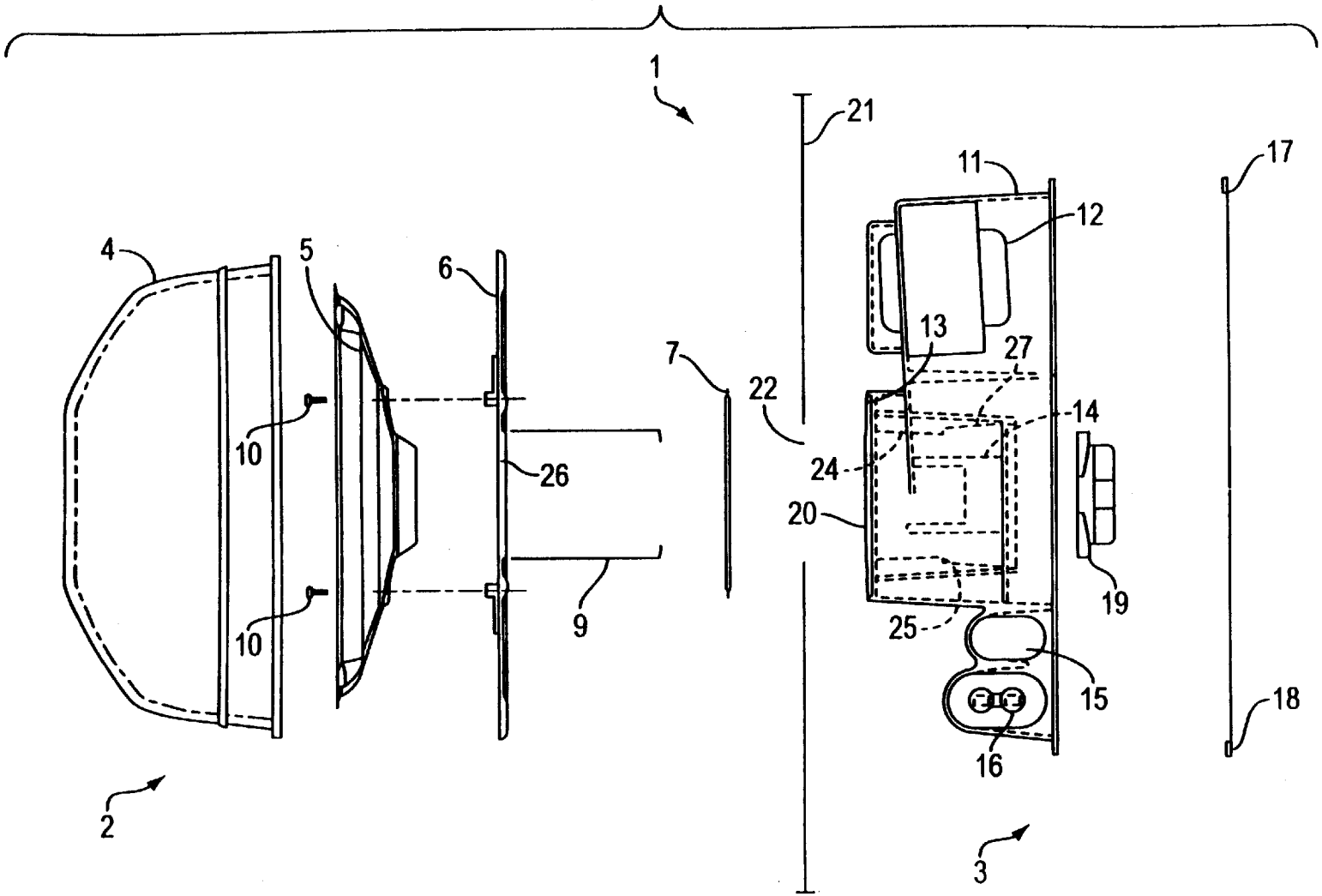
FIG. 1 is an expanded side view of a canopy luminaire assembly according to one embodiment of the present invention.
Figure 6:
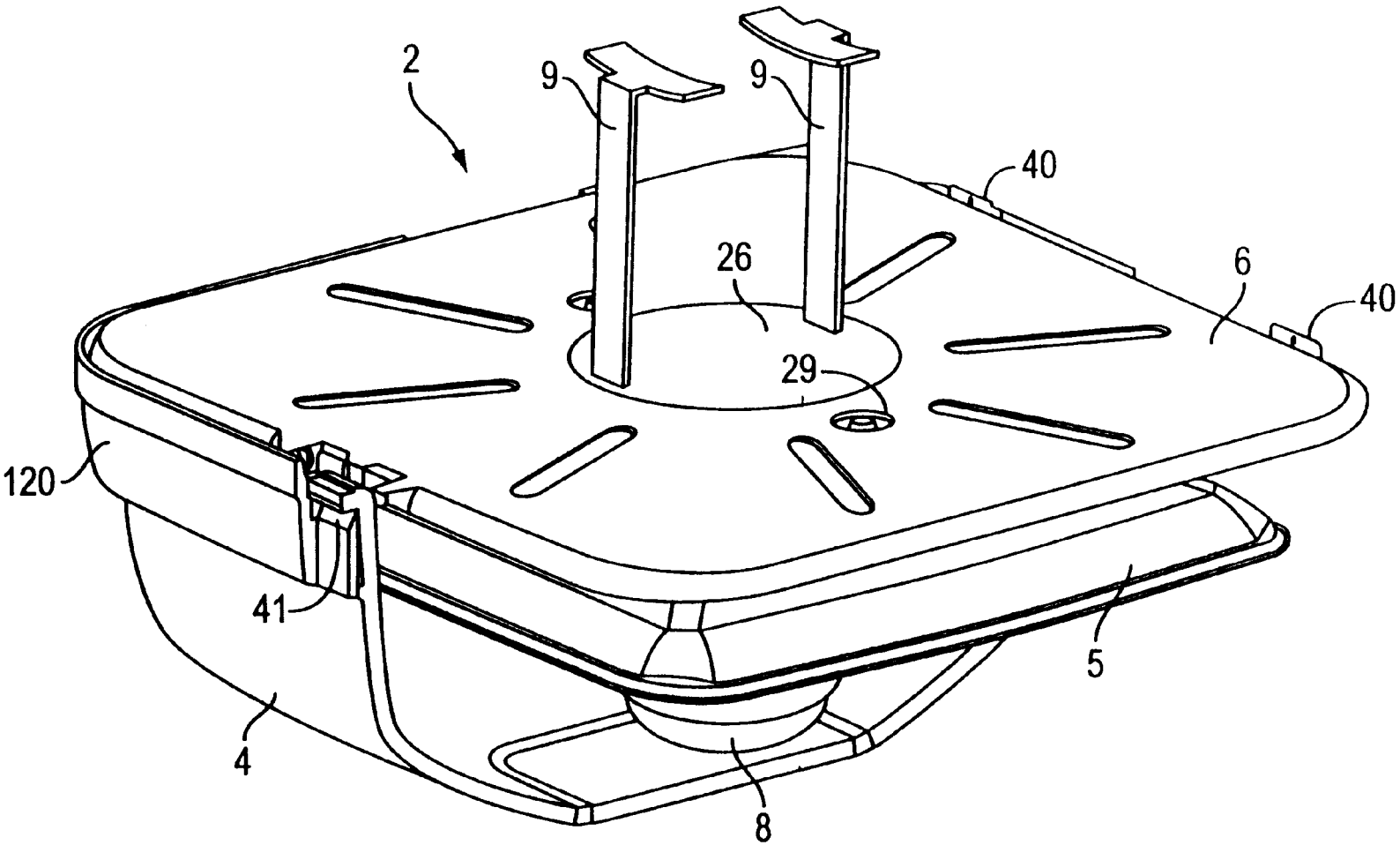
FIG. 6 is an isometric view of a lower portion according to one embodiment, with a partial cut away of a lens according to one embodiment of the present invention.

FIG. 1 illustrates an expanded side view of a canopy luminaire 1 according to one of the embodiments of the present invention. The canopy luminaire assembly 1 comprises a lower portion 2 and a ballast section 3. The lower portion 2 may include a lens 4 and a reflector 5. Reflector 5 may be attached to a base pan 6 by fasteners 10. Lens 4 may be attached to base pan 6. A light source 8 (FIG. 4) is located within lens 4. Base pan 6 may be provided with one or more draw clamp brackets 9 which may extend up from reflector 5. As shown, draw clamp brackets 9 may be attached to base pan 6 by fasteners 29 (FIG. 6). In one embodiment according to the present invention, draw clamp bracket 9 may be substantially perpendicular to the plane of the base pan 6. Other arrangements may also be used. A gasket 7 may be placed around the draw clamp brackets 9 and onto the base pan 6. Gasket 7 helps to seal the canopy luminaire assembly and may be made of rubber, foam, or other known material.

Ballast section 3 may include a ballast housing 11 and a top cover 17. Ballast housing 11 may contain a ballast 12, a starter 15, and a capacitor 16. Top cover 17 may fit on the ballast housing 11 with a cover gasket 18 disposed between top cover 17 and ballast housing 11. Ballast housing 11 may rest on a canopy 21, with a ballast housing aperture 20 aligned with a canopy aperture 22.

An overview of the assembly is now provided. Base pan 6, reflector 5, draw clamp brackets 9, and lens 4 may be assembled and attached together to form lower portion 2. Additionally, ballast housing 11 may be assembled to include ballast 12, capacitors 16, and starter 15. As discussed in more detail below, ballast housing 11 may also have an aperture portion 20 disposed in a lower portion of ballast housing 11. Aperture 20 may have a circumference approximately equal to the size of canopy aperture 22. To assemble lower portion 2 to ballast housing 11, any manner of providing a component that attaches to another component may be provided. According to one embodiment, however, draw clamp brackets 9 may cooperate with aperture 20 to secure lower portion 2 to ballast housing 11 through canopy aperture 22. Ballast housing aperture 20 may be located in the lower portion of ballast housing 11. Draw clamp brackets 9 are inserted into ballast housing aperture 20 located within ballast housing 11 to secure lower portion 2 to ballast housing 11. According to another embodiment, a locking cam 19 may be used to secure lower portion 2 to ballast housing 11.

As shown in FIG. 1, and as will be described in more detail, ballast housing 11 may be located directly over lower portion 2 on canopy 21. Additionally, ballast 12, capacitor 16, and starter 15 may be contained in a ballast housing 11, away from light source 8. This protects the contents of ballast housing 11 from increases in operating temperature, and thus extends the life of the components. The various components and detail of these components will now be described.

Figure 2A:
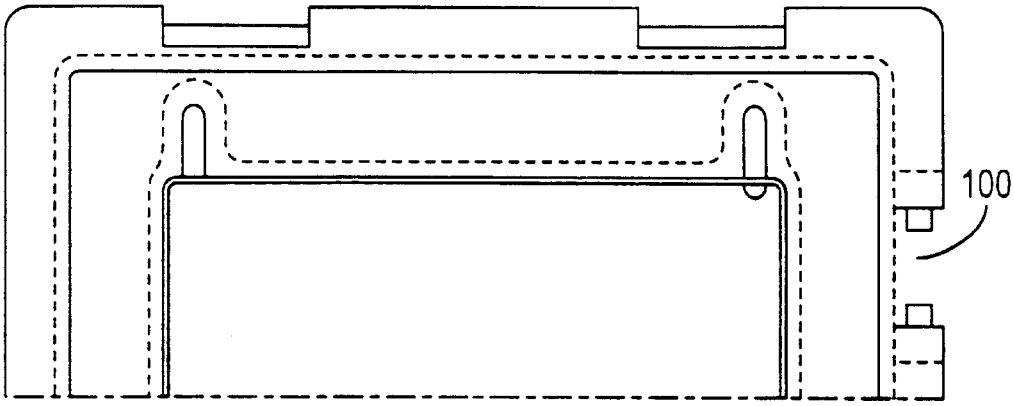
FIG. 2(*a*) is a top view of a ballast housing according to one embodiment of the present invention FIG. 2(*b*) is a side view of a ballast housing according to one embodiment of the present invention
Figure 2B:
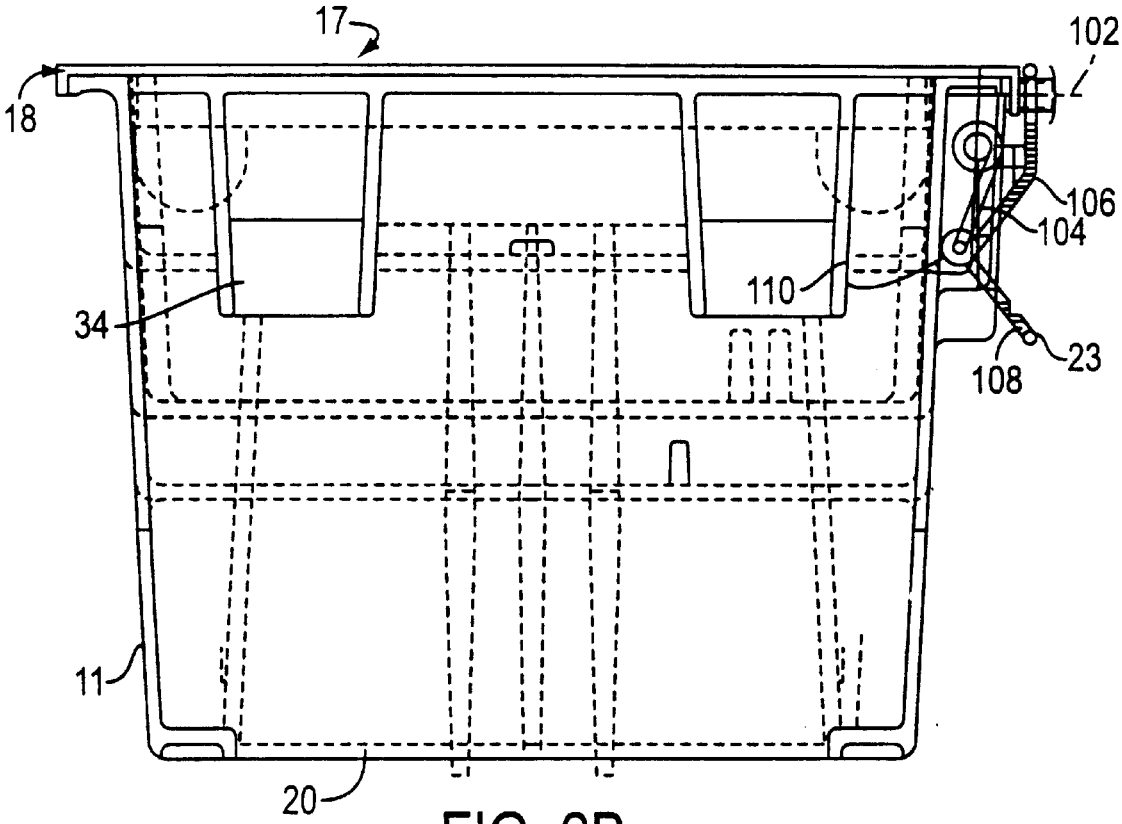

FIG. 2(*b*) provides a side view of ballast housing 11 and FIG. 2(*a*) provides a partial overview of a ballast housing 11. As also shown in FIG. 1, a cover gasket 18 may be placed between top cover 17 and ballast housing 11. Cover gasket 18 may be comprised of a rubber sealing gasket used for preventing leakage into and out of ballast housing 11. Any material used for such purposes may be used for cover gasket 18.

A fastening device 23 may be used to attach top cover 17 to ballast housing 11. According to one embodiment of the present invention, fastening device 23 may comprise a bail latch, as shown in FIG. 2(*b*). In this embodiment, ballast housing 11 may be provided with one or more bail latch attachment mechanisms 100 that extend from one side of ballast housing 11. Additionally, top cover 17 may be provided with one or more bolts 102 extending from the side edge of top cover 17. Bail latch 23 then may comprise three cooperating components: a ballast housing attachment component 104, a top cover attachment component 106, and a bail latch closing component 108. Ballast housing attachment component 104 may have an opening that fits over bail latch attachment mechanism 100 that allows it to swing about bail latch attachment mechanism 100. Ballast housing attachment mechanism 100 connects to top cover attachment component 106 and bail latch attachment component 108 at junction 110.

Bail latch 23 operates by inserting bolt 102 through an opening at one end of top cover attachment component 106 into top cover 17. Bail latch closure component 108 may then be pressed down, pulling top cover attachment component 106 down to tighten top cover 17 to ballast housing 11. By providing such an arrangement, tool-less assembly of top cover 17 to ballast housing 11 is provided. Other mechanisms that permit tool-less assembly of top cover 17 to ballast housing 11 may also be provided. Additionally, other attachment mechanisms may be provided that may entail use of tools as well. Securement of top cover 17 to ballast housing 11 prevents leaking of the elements into ballast housing 11, particularly with the use of a gasket such as gasket 18, for example.

Often times, canopies 21 that the canopy luminaire assembly of the present invention is to be used with may be very thin. For example, canopy 21 may be made of a light-weight metal. Accordingly, it may be desirable to provide additional structures to support the weight of the ballast housing 11 and lower portion 2. Thus, ballast housing 11 may be supported on canopy 21 in such a way as to not bend the canopy 21 due to the weight of housing.

Figure 3:
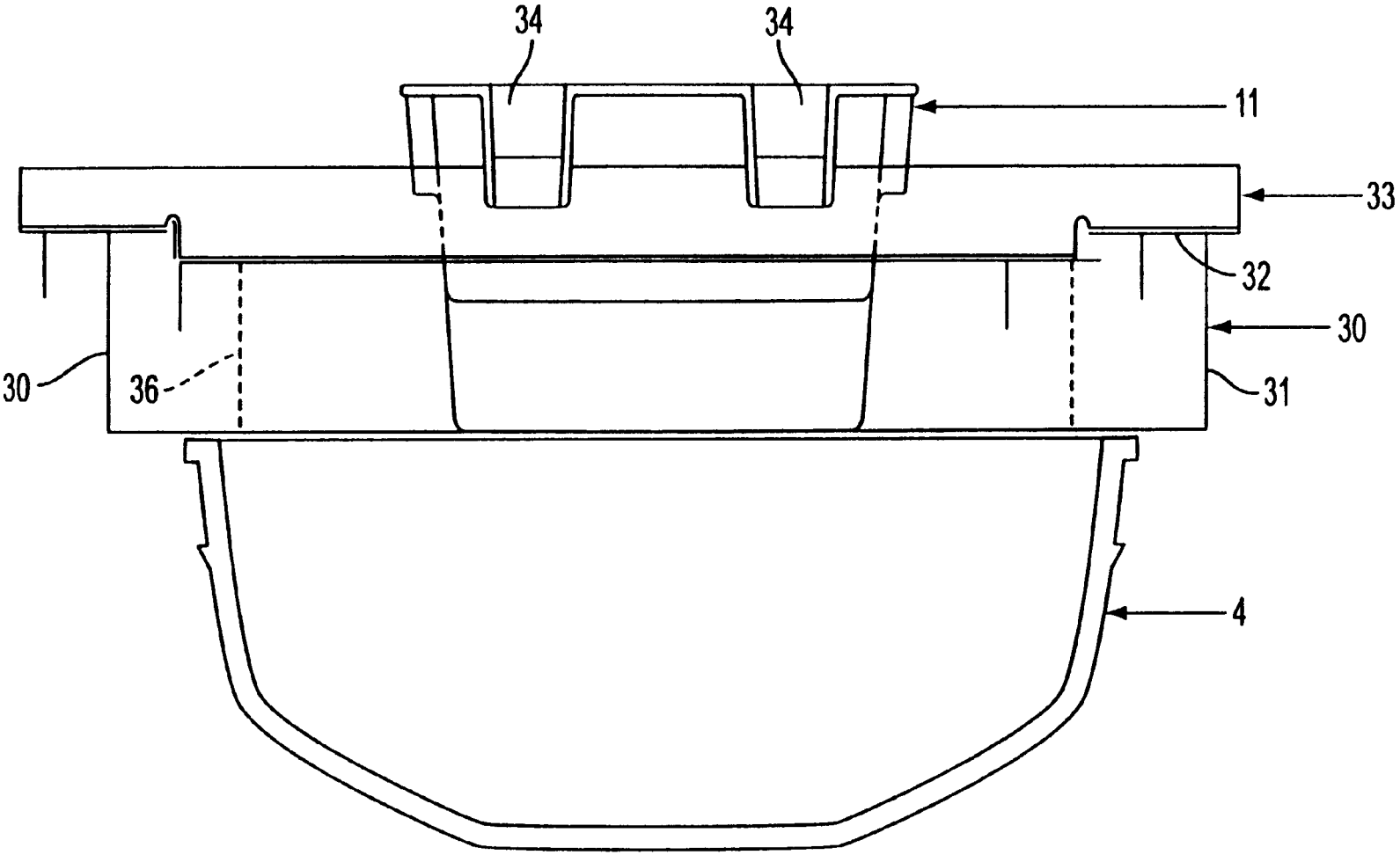
FIG. 3 is a front view of a canopy luminaire assembly according to one embodiment of the present invention.
Figure 4:
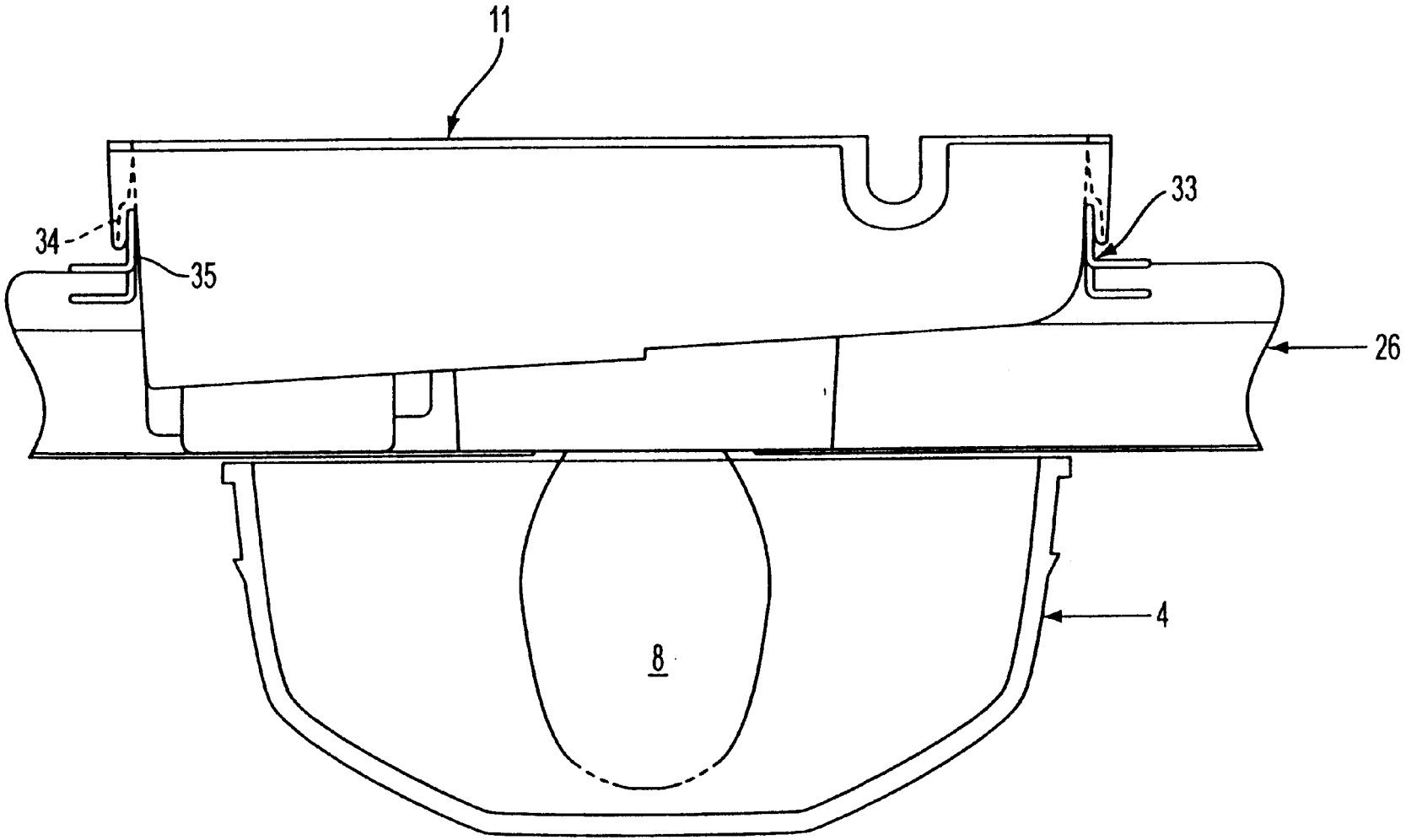
FIG. 4 is a side view of a canopy luminaire assembly according to one embodiment of the present invention.

According to one embodiment of the present invention, canopy ribs 30, as illustrated in FIG. 3 and 4, may be provided on canopy 21. In one embodiment, canopy ribs 30 may include a perpendicular rib portion 31, which is perpendicular to canopy 21, and a parallel rib portion 32, which is parallel to canopy 21. Perpendicular rib portion 31 and parallel rib portion 32 may be connected such that they form an "L" shape extending from the canopy 21. Canopy rib 30 may also be of other configurations. According to the present invention, these canopy ribs 30 may be used to support the weight of ballast housing 11. Accordingly, extensions 34 from ballast housing 11 may be provided that support the weight of ballast housing on canopy ribs 30. According to one embodiment, deck supports 33 may be placed so as to be supported by parallel rib portions 32. Ballast housing 11 may be provided with extensions, or flanges, 34 which receive the upper portion of deck support 33 such that ballast housing aperture 20 is aligned with canopy aperture 22. Thus, ballast housing 11 is supported by canopy 21 through deck support 33 and canopy ribs 30. Other canopy rib configurations may also be used, depending upon the needs of the user. Deck supports 33 may be made of any material, for example metal or plastic, of sufficient strength to support ballast housing 11. For example, deck support 33 may be made of aluminum, steel, or other such material. In one embodiment, deck support 33 may be made of 14 gauge aluminum. Other materials of sufficient strength, such as fiberglass, plastic, and the like, may also be used.

Canopy ribs 30 may be located in a number of places on the canopy 21, and may be different heights. In one embodiment of the invention, desk support 33 may be designed so that one deck support 33 configuration may work with canopy ribs of various sizes or locations. For example, FIG. 3 illustrates second canopy ribs 36, where second canopy ribs 36 may have a different size and location than canopy ribs 30. In one embodiment of the present invention, second canopy ribs 36 may be configured so as to resemble canopy ribs 30, i.e. also have a perpendicular portion and a parallel portion. In one embodiment of the invention, the deck support 33 is supported on parallel portions of only one size of canopy ribs 30. That is, only one configuration of canopy ribs is used to support deck support 33. In another embodiment, however, deck support 33 may be designed so that a variety of canopy rib configurations can support deck support 33. The design of deck support 33 may also vary depending upon the design and configuration of canopy ribs.

Located around an outer, upper rim of the ballast housing are flanges 34, which may cooperate with deck support 33 and thereby support ballast housing 11. Ballast housing 11 may be supported on deck support 33 by flanges 34. In one embodiment of the present invention, a gap may be located between flanges 34 and ballast housing 11 Ballast housing 11 may be placed within deck support 33, and deck support sides 35 support ballast housing 11 by being located in gaps between flanges 34 and ballast housing 11.

According to one embodiment, as shown in FIGS. 1–4, ballast housing 11 may be located directly over lower portion 2. The weight of ballast housing 11 may be supported entirely on canopy 21 by canopy ribs 30. Canopy 21 may therefore be located between lower portion 2 and ballast section 3. Ballast housing 11, in one embodiment, may be to made of die cast metal, such as, for example, aluminum. Ballast housing 11 may also be made of molded plastic, or other material of sufficient strength to support components located within ballast housing 11. Die cast or molded construction helps to prevent leakage into ballast housing 11 without the use of gaskets or other sealing mechanisms. Other methods of manufacturing ballast housing 11 may also be used.

Figure 5:
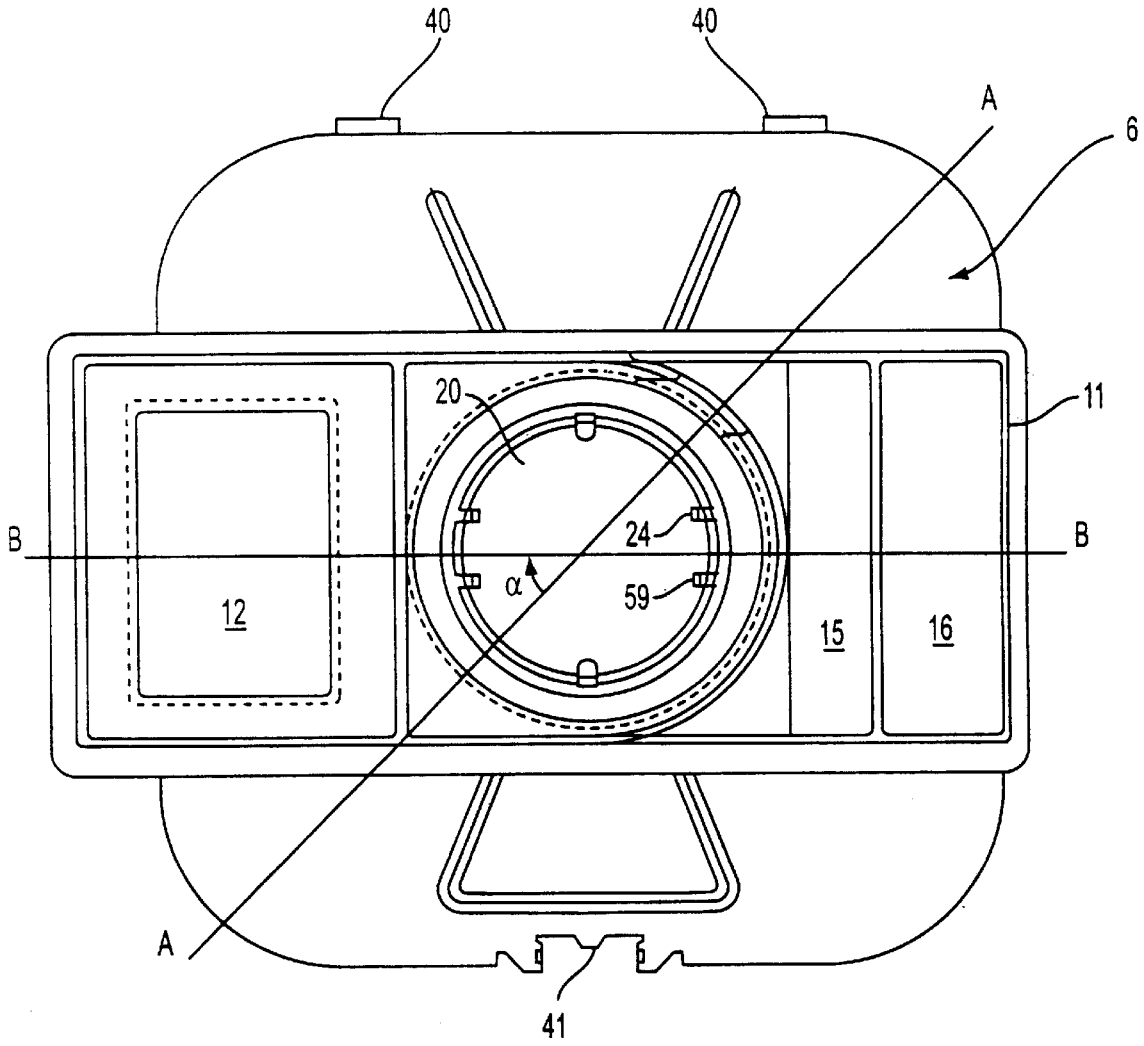
FIG. 5 is a top view of a canopy luminaire assembly according to one embodiment of the present invention.

FIG. 5 further illustrates a top view of canopy luminaire assembly 1 with lower portion 2 and ballast section 3 attached and with top cover 17 removed. This view shows base pan 6 may be attached to and located below ballast housing 11. Inside ballast housing 11 is a ballast 12, a starter 15, and a capacitor 16. In one embodiment, hinges 40, and a latch 41 are located on the base pan 6. Hinges 40 and latch 41 allow lens 4 (FIG. 1) to be opened to allow changing of light source 8 (FIG. 4). In one embodiment of the present invention, base pan 6 may be made of a material of sufficient strength to support lens 6 and reflector 5. Base pan 6 may be made of, for example, aluminum, plastic, or other such material. Base pan 6 may also be molded or die cast. Other embodiments of base pan 6 may also be used. This embodiment is explained later in further detail. FIG. 5 further shows ballast housing aperture 20.

This embodiment allows a single individual to install a canopy luminaire assembly 1 without the need for tools. An individual may place ballast section 3 on a canopy 21, as described above, with or without the use of deck support member 33 to support. Ballast housing aperture 20 is aligned by the individual over canopy aperture 22. Lower portion 2 is temporarily attached to ballast housing 11 by inserting draw clamp brackets 9 through canopy aperture 20 and ballast housing aperture 22. Locking cam 19 may be used to permanently attach lower portion 2 to ballast section 3. No tools are required when using the locking cam to permanently attach the lower portion 2 to the ballast section 3 through the canopy 21.

FIG. 6 is an isometric view of light fixture 2, with a partial cut away of lens 4. Lighting section 2 may have a reflector 5 attached to a base pan 6 by fasteners 29, for example, fasteners 29 may comprise screws or any other type of connector. Hinges 40 and a latch 41 may serve to connect a lens 4 to base pan 6, while still allowing access to light source 8. Draw clamp bracket 9 extends through base pan aperture 26. A bezel 120 may also be provided as described in more detail below.

Figure 7:
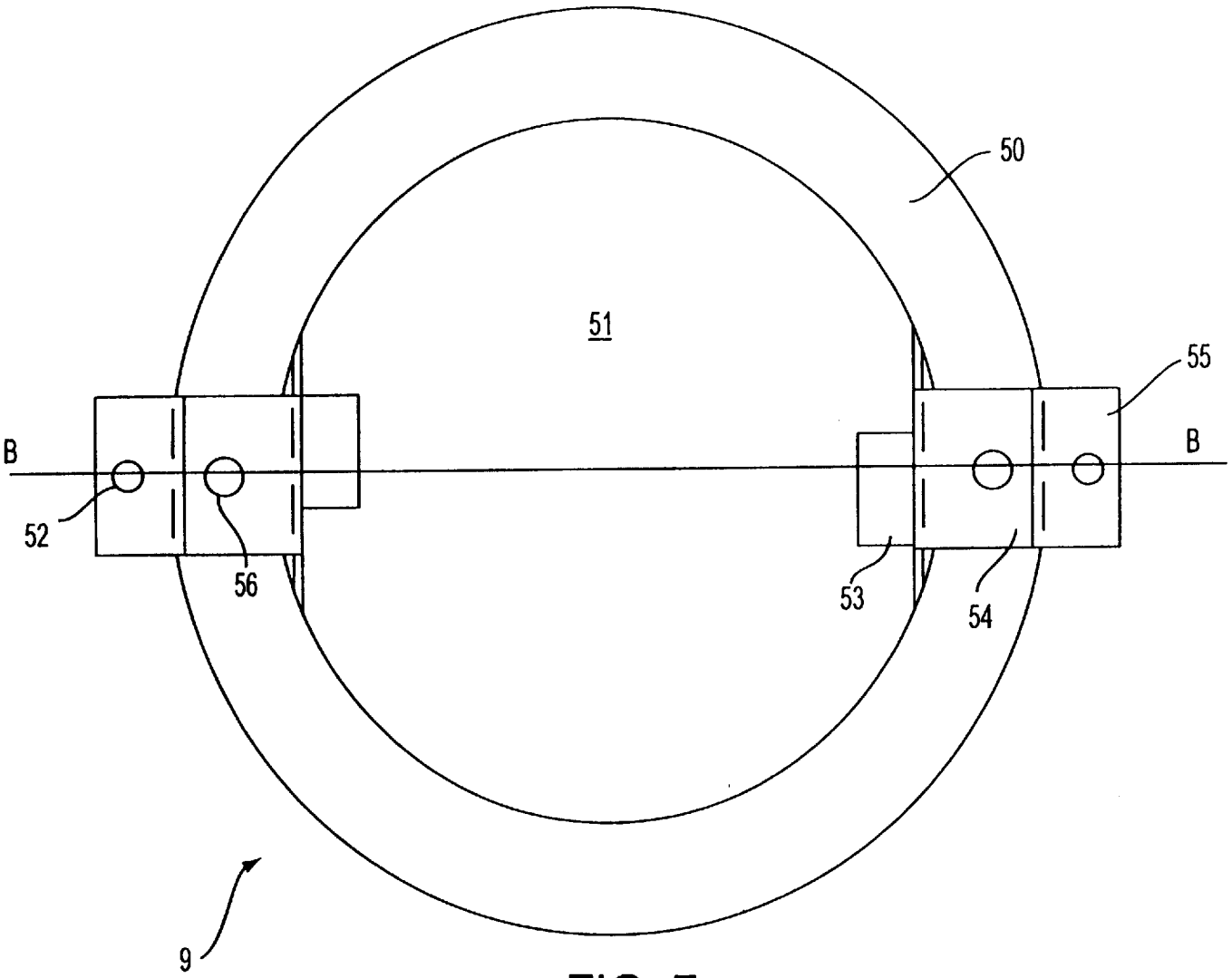
FIG. 7 is a bottom view of one embodiment of a draw clamp bracket according to one embodiment of the present invention.
Figure 8:
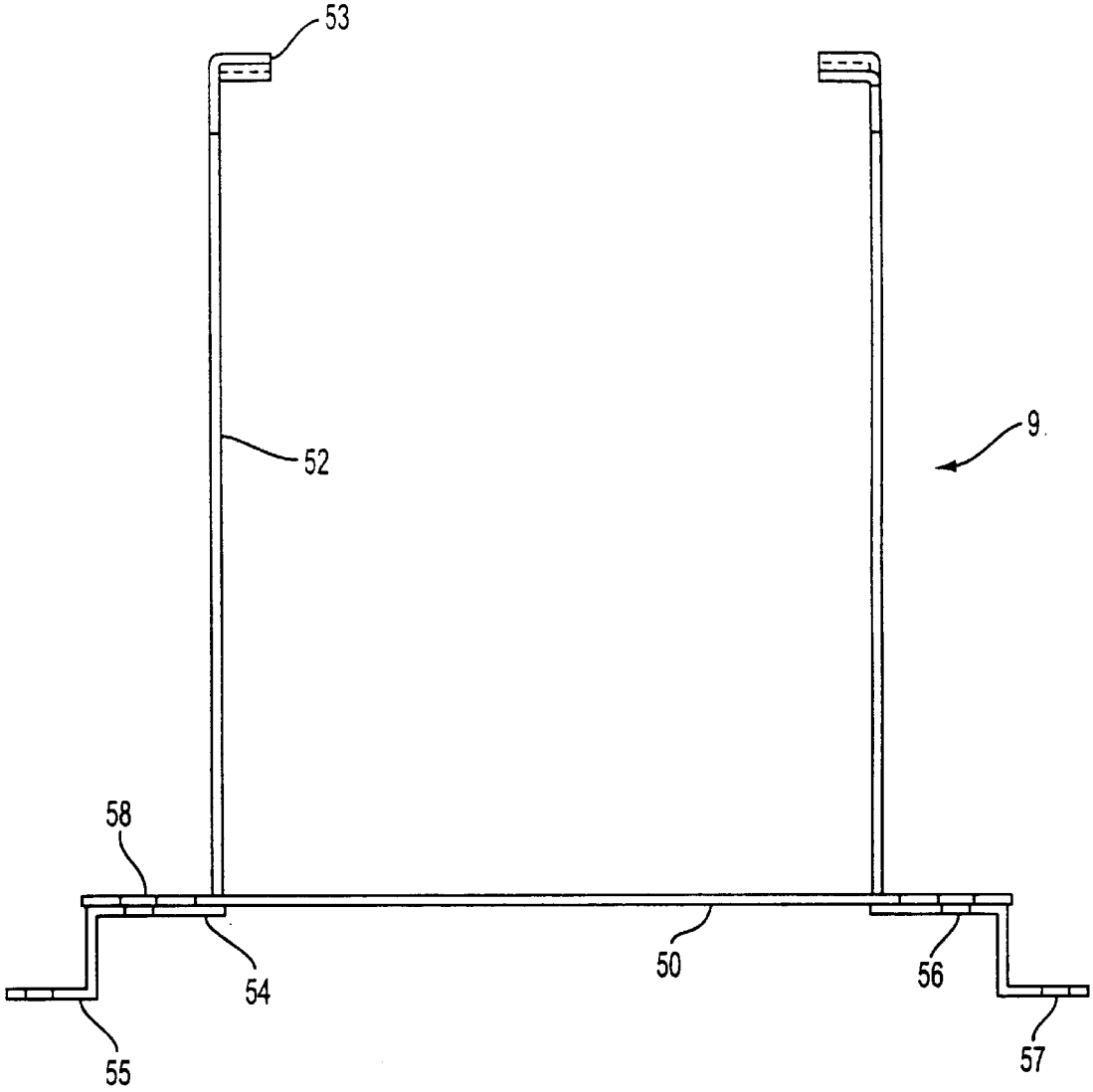
FIG. 8 is a front view of one embodiment of a draw clamp bracket according to one embodiment of the present invention.
Figure 9:
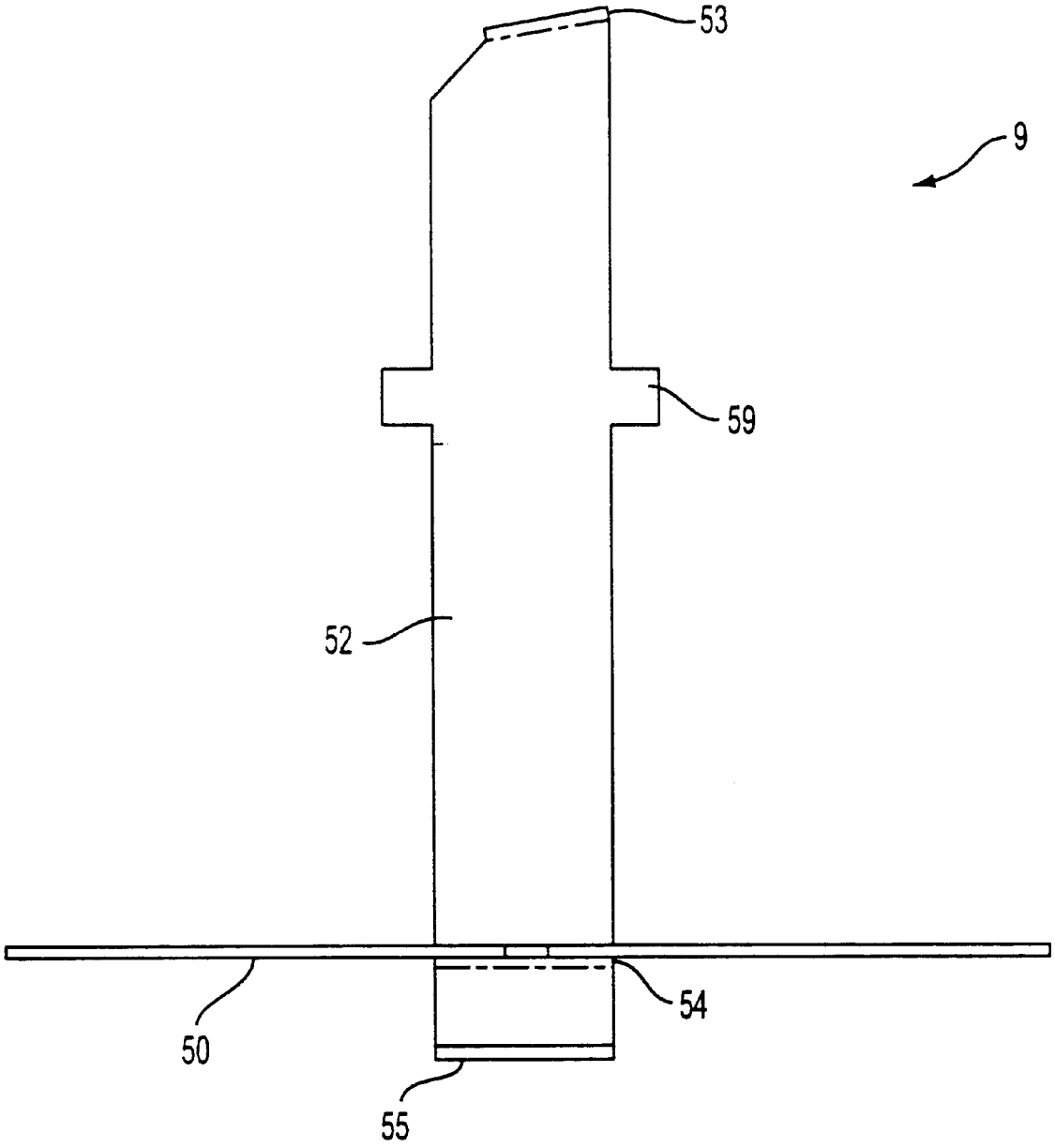
FIG. 9 is a side view of one embodiment of a draw clamp bracket according to one embodiment of the present invention.

The operation of ballast housing aperture 22 and draw clamp brackets 9, as shown in FIGS. 7, 8, and 9, will now be explained in greater detail. Draw clamp brackets 9 may be connected to a ring plate 50, having a ring aperture 51. Ring plate 50 may extend down from base pan 6 and provides the surface to which draw clamp brackets 9 may be connected to base pan 6. Draw clamp brackets 9 may comprise an extension portion 52, a ring plate platform 54, reflector platform 55, ring plate platform aperture 56, and reflector platform aperture 57. Draw clamp brackets 9 may be attached to ring plate 50 by fasteners 10, which may connect through ring plate platform aperture 56 and ring plate aperture 58. Reflector 6 may then be connected to draw clamp brackets 9 by fasteners at reflector platform aperture 57. Fasteners 10 may comprise screws, or any other device for attaching two components. Ring plate platform 53 and ring plate 50 may also be attached by other means, such as, for example, glue or welding.

As noted previously, draw clamp brackets 9 may be inserted through canopy aperture 22 and ballast housing aperture 20, and into ballast housing 11. Ballast housing 11, as shown in FIG. 1, also has first bracket walls 24, which extend into ballast housing 11 from ballast housing aperture 20. According to one embodiment of the present invention, first bracket walls 24 may be tapered inward toward the center of canopy aperture 22. In addition, first bracket walls 24 may be provided with bracket notches 25 formed between the inner edge of first bracket wall 24 and second bracket wall 27. According to one embodiment, first bracket walls 24 may have an insert portion to receive extension portion 52 and between bracket notches 25.

Draw clamp brackets 9 may be inserted into ballast housing 11. According to one embodiment, draw clamp brackets 9 may be spaced so that winged bracket portion 59 of draw clamp brackets 9 press against first bracket wall 24, causing dovetail platforms 53 to deflect toward each other, because first bracket wall 24's inner diameter may be less than the diameter between extension portions 52. Along first bracket walls 24 are bracket notches 25. When draw clamp brackets 9 are inserted to where winged bracket portions 59 are above bracket notches 25, draw clamp brackets 9 set into the insert portion of bracket walls 24, and bracket tabs 59 rest in bracket notches 25, thereby holding lower portion 2 within ballast housing 11. This embodiment allows for tool-less attachment of lower portion 2 to ballast housing 11. Other methods of tool-less securing of draw clamp brackets 9 within ballast housing 11 may also be used. Additionally, other methods of using tools to secure draw clamp brackets 9 within ballast housing 11 may also be used. Other methods, both using tools and without using tools, may include fasteners, glue, welding or the like.

According to another embodiment of the present invention, as illustrated in FIGS. 47–50, draw clamp brackets 9 have a ring plate 50, ring aperture 51, extension portion 52, and dovetail platform 53. Draw clamp bracket 9 may also include ring plate platform 54 with a ring plate platform aperture 56. Ring plate platform aperture 56 may align with ring plate aperture 58 to allow attachment of ring plate platform 54 and ring plate 50. Attachment may be made by a fastener, such as a screw, a bolt, or other known fastening means. Another embodiment may also use gluing or spot welding to attach ring plate 50 and ring plate platform 54.

Figure 49:
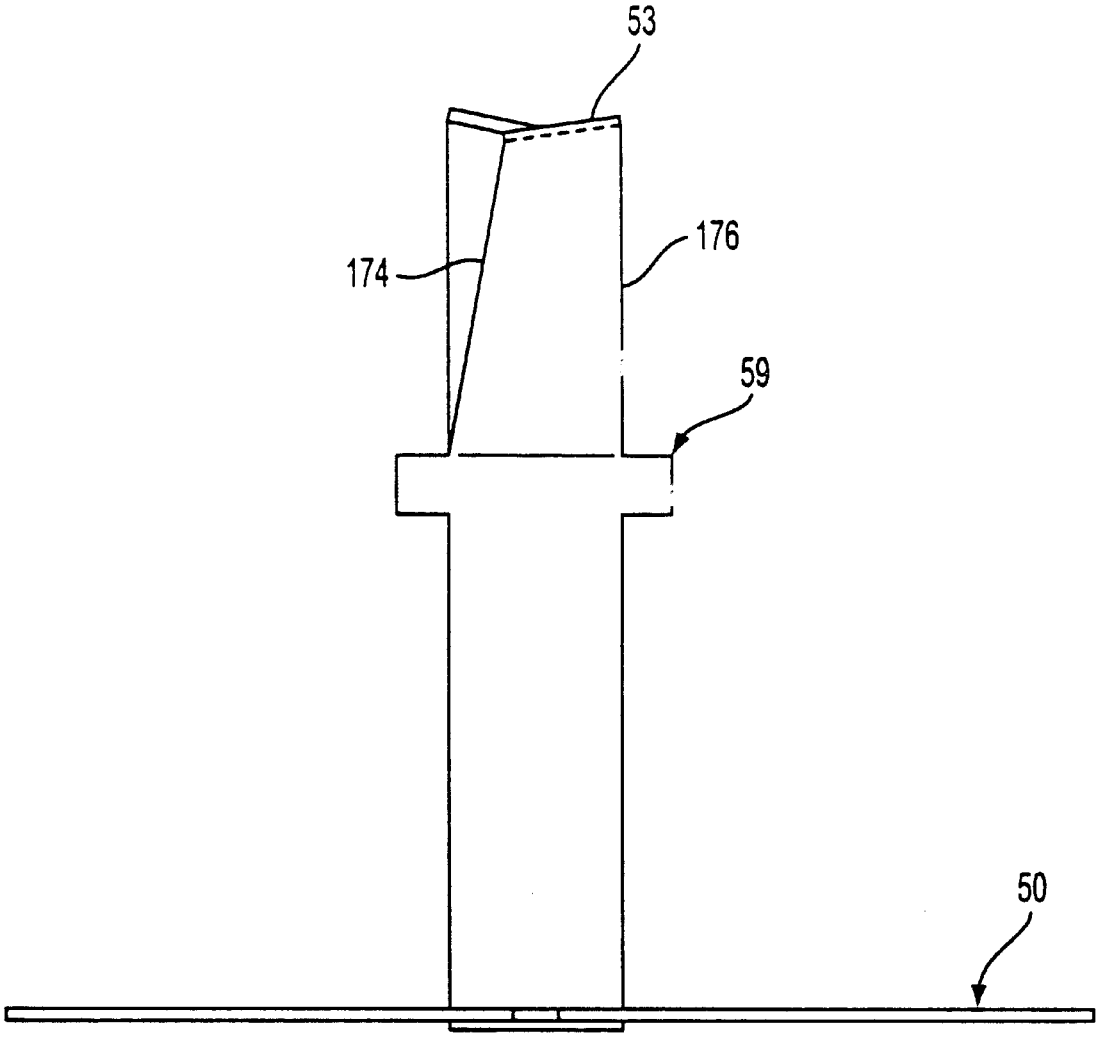
FIG. 49 depicts another side view of a draw clamp bracket according to another embodiment of the present invention.

Extension portion 52 may also have a winged bracket portion 59, as illustrated in FIG. 49. Extension portion 52 may also have a bend 170 and a bent portion 172. In one embodiment, bent portion 172 may be bent in a direction away from the center of draw clamp bracket 9. Other orientations of bent portion 172 may also be used. Bent portion 172 may be have a tapered portion 174. In one embodiment, tapered portion 174 may be disposed on only one side of bent portion 172. Tapered portions 174 on bent portions 172 may also be aligned so that when extension portions 52 are aligned, tapered portions 174 are not disposed along the same access through the center of ring plate 50. Other locations for tapered portion 174 may also be used.

In one embodiment of the present invention, dovetail platform 53 may be slanted in relation to ring plate 50, as illustrated in FIG. 49. The portion of dovetail platform 53 that is attached to tapered portion 174 of bent portion 172 may be lower than the portion of dovetail platform 53 that is attached to straight portion 176 of bent portion 172. In one embodiment, the slant of dovetail platform 53 may be at any angle sufficient to allow locking cam 19 to function to secure lower portion 2 via draw clamp brackets 9. Such an angle may, in one embodiment, approximately match the angle of teeth 63 of locking cam 19 (FIGS. 10 and 11), to be described in greater detail below. In one embodiment of the present invention, dovetail platform 53 has a slant of approximately 10° from parallel to ring plate 50. Draw clamp brackets 9 may be made of 3A aluminum. In one embodiment, draw clamp bracket 9 and locking cam 19 may be made of zinc.

Figure 50:
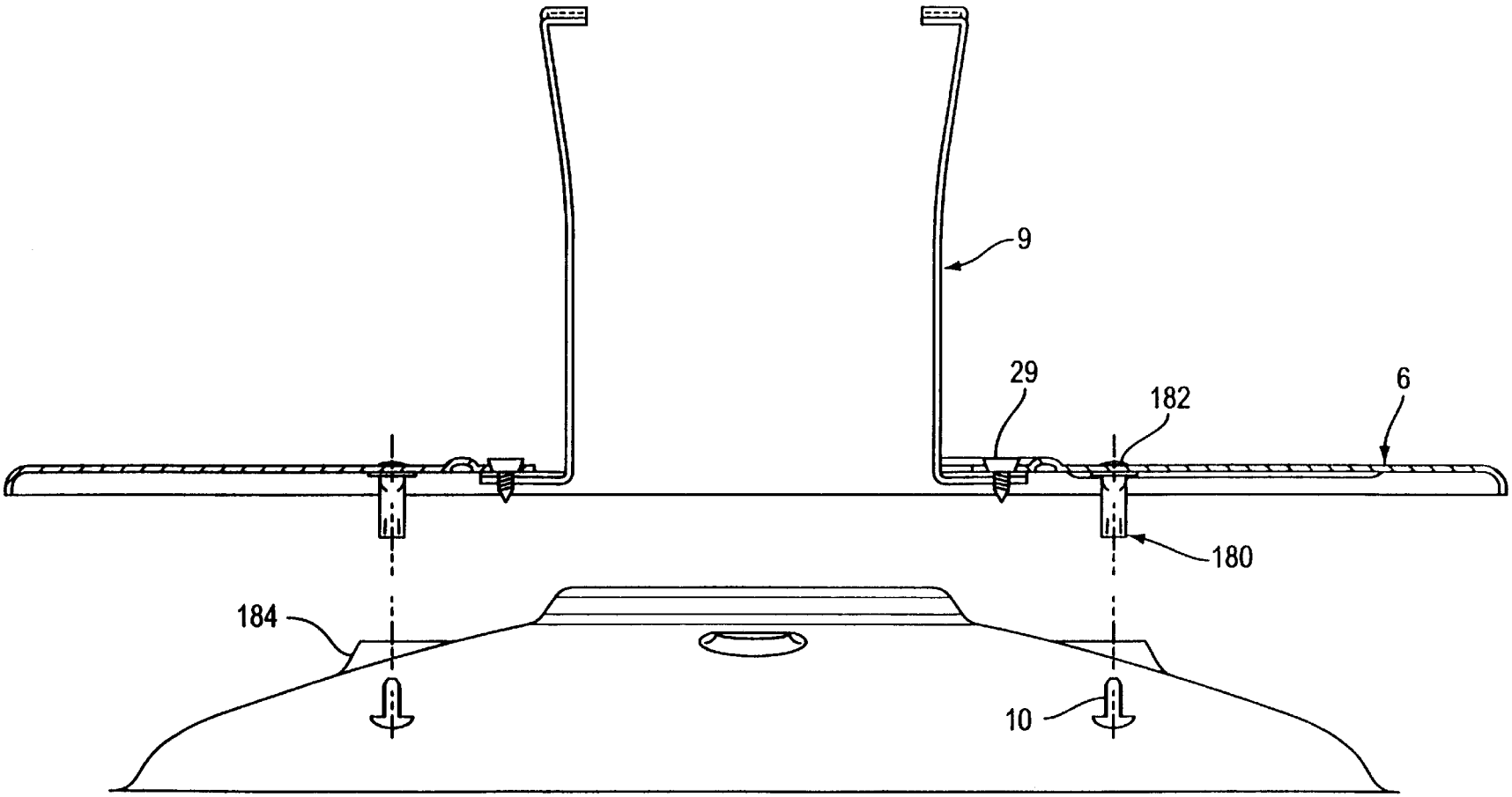
FIG. 50 depicts a side view of a draw clamp bracket according to another embodiment of the present invention, where the draw clamp bracket is attached to a base pan.

FIG. 50 illustrates attachment of reflector 5 and base pan 6 to draw clamp brackets 9 of one embodiment. Draw clamp brackets 9 may be attached to base pan 6 using fasteners 29, as described in a previous embodiment. A standoff stopper 180 may be used to attach base pan 6 to reflector 5. Standoff stopper 180 may have a fastener portion 182 which attaches to base pan 6. Fastener 10 may be attached to standoff stopper 180 at an end opposite fastener portion 182. In one embodiment, standoff stopper 180 may be attached to a shoulder portion 184 of reflector 5. Standoff stopper 180 may be made of a metal such as aluminum or zinc. Standoff stopper 180 may also be made of other materials, such as, for example, plastic.

Figure 10:
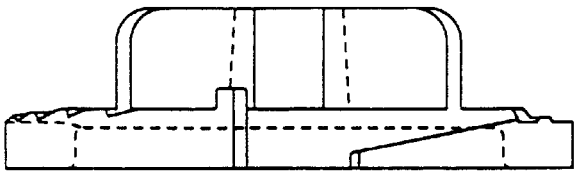
FIG. 10 is a side view of a locking cam according to one embodiment of the present invention.
Figure 11:
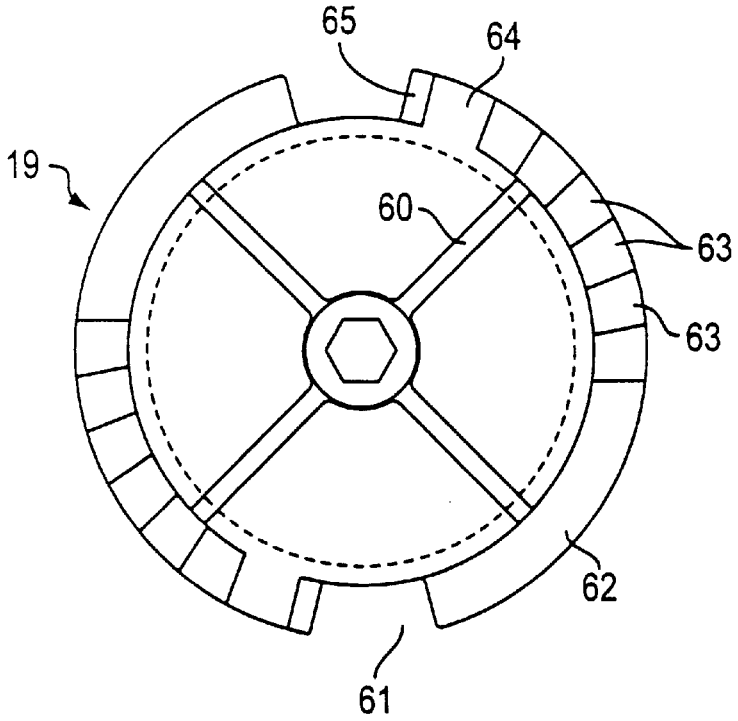
FIG. 11 is a top view of a locking cam according to one embodiment of the present invention.

In one embodiment, a locking cam 19 may be used to further secure lower section 2 to ballast section 3. FIGS. 10 and 11 disclose a side view and a top view of locking cam 19. In one embodiment of the present invention, locking cam 19 has a handle portion 60, an indent 61, a ramp 62, teeth 63, a plateau area 64, and a stop 65. Locking cam 19 may be positioned such that dovetail platforms 53 of draw clamp brackets 9 are inserted into indent 61. A user then rotates locking cam 19 by using handle portion 60, such that dovetail platforms 53 slide over ramp 62, and teeth 63. Locking cam 19 may be turned until dovetail platform 53 reaches plateau area 64. Stop 65 prevents the locking cam 19 from being turned any farther. In one embodiment of the present invention, teeth 63 are formed in such a way as to allow the dovetail platforms 53 to easily slide over the teeth 63 when the locking cam 19 is being turned to lock light fixture 2 into place, while preventing dovetail platforms 53 from sliding the other way without the help of a user. A user may push locking cam 19 in downward motion while turning. This prevents the dovetail platforms from catching on teeth 63 of locking cam 19.

Figure 12:
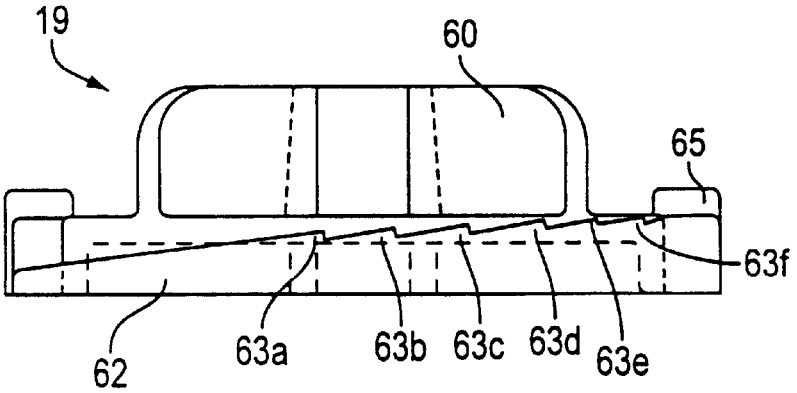
FIG. 12 is another side view of a locking cam according to one embodiment of the present invention.

FIG. 12 offers another side view of one embodiment of locking cam 19. Ramp 62 leads to teeth 63*a*–63*f*, which is turn lead to plateau 64 and stop 65. As can be seen, in one embodiment of the invention, each successive tooth 63*a*–63*f* has an elevation higher than the previous tooth. So, for example, the highest point on tooth 63*b* is higher than the highest point on tooth 63*a*, but lower than the highest point on tooth 63*c*. Thus, the highest point on tooth 63*f* is higher than the highest point on any other tooth. Other embodiments of locking cam 19 may also be used. Locking cam 19 may, for example, have only one tooth 63 for preventing dovetail platforms 53 from sliding.

Figure 13:
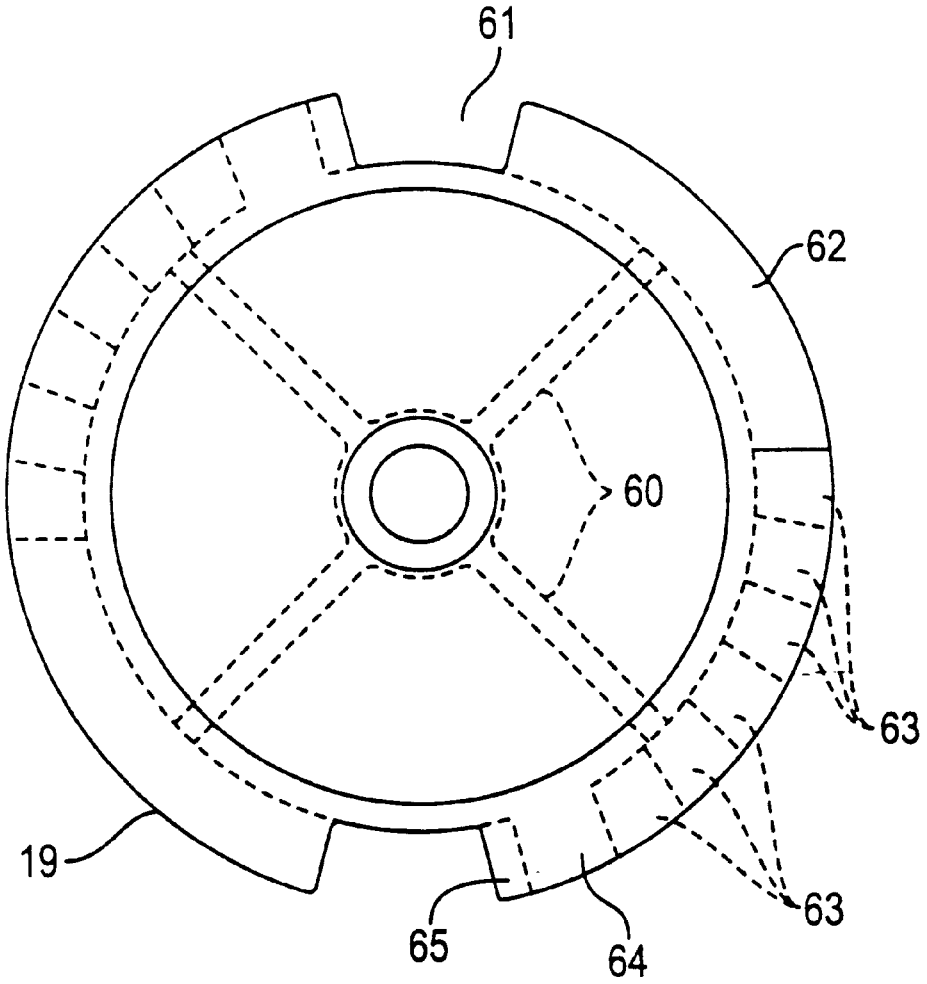
FIG. 13 is a bottom view of a locking cam according to one embodiment of the present invention.
Figure 14:
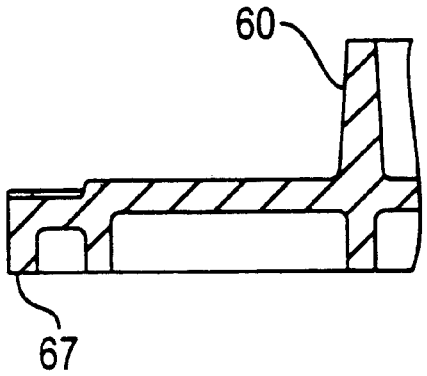
FIG. 14 is a side cut away view of a locking cam according to one embodiment of the present invention.

FIGS. 13 and 14 illustrate in greater detail one embodiment of locking cam 19. Sections of locking cam 19 may be hollowed out, thus allowing locking cam 19 to perform its function with less weight. Edge portion 67 of locking cam 19 rest against second bracket walls 26 (see FIG. 1) when holding the lighting fixture 2. In one embodiment, locking cam 19 may be manufactured to have a hollow bottom portion, thereby using less material and having a lighter locking cam 19. Other configurations may also be used. Locking cam 19 may be made of any material of sufficient strength to support lower portion 2. Such materials may include plastic, aluminum, steel, or the like. In one embodiment of the present invention, locking cam 19 is made of zinc casting. In one embodiment of the present invention, locking cam 19 is made from molded plastic. Another embodiment may contemplate making locking cam 19 using die-cast metal. Other embodiments may also be used.

In one embodiment of the present invention, locking cam 19 lifts draw clamp brackets 9 upward, thereby also lifting lower portion 2. As noted above (FIG. 1), in one embodiment of the present invention, a gasket 7 may be placed between base pan 6 and canopy 21. Gasket 7 helps to prevent components in ballast housing 7 from outside elements, such as dirt, water, and similar objects. Gasket 7 may be comprised of a rubber sealing gasket used for preventing leakage of fluids into and out of ballast housing 11. Any material used for such purpose may also be used for gasket 7. According to one embodiment of the present invention, gasket 7 may be of sufficient thickness to maintain a seal between base pan 6 and canopy 21 when a locking cam 19 is used to attach lower portion 2. As discussed above, locking cam 19 may be turned so that draw clamp brackets 9 may be lifted upward, thereby lifting lower portion 2. Lifting lower portion 2 causes base pan 6 to be lifted toward canopy 21, thereby compressing gasket 7. In one embodiment, draw clamp brackets 9 may be of a length such that base pan 6 comes in contact with canopy 21 when locking cam 19 is used. Due to variations in tolerances, draw clamp brackets 9 may be of such a length that base pan 6 does not contact canopy 21 when locking cam 19 is used, thereby creating a gap. Thus, in one embodiment, gasket 7 may be of sufficient thickness to fill a gap created between base pan 6 and canopy 21 when base pan 6 would not contact canopy 21, thereby creating a sealing. Variations in tolerances may also cause draw clamp brackets 9 to be of such a length that base pan 6 would be pulled through canopy 21 when locking cam 19 is used. Thus, in one embodiment of the present invention, gasket 7 may be made of a material which permits sufficient compression, and canopy 21 may be made of a bendable material. This embodiment allows locking cam 19 to be used to attach lower portion 2 to ballast housing 11.

Once locking cam 19 is supporting lower portion 2, bracket tabs 59 on draw clam brackets 9 may not support lower portion 2. Locking cam 19 may rest in a hollow 28 in ballast housing 11, and may be free to rotate within hollow 28. As shown, lower portion 2 and ballast portion 3 are thus connected by draw clamp brackets 9. In one arrangement, as shown in FIG. 5, edges of ballast housing 11 and edges of base pan 6 having latch boss 41 and hinge bosses 42 substantially parallel. In some embodiments, however, it may be required to have the orientation of lower portion 2 and ballast portion 3 be different. For example, other components may be in the way on canopy 21, or under canopy 21.

According to the present invention, the respective arrangement between the two portions may be made as desired by rotating draw clamp brackets 9 around ring plate 50 on base pan 6. As shown in FIG. 7, draw clamp brackets 9 secure to ring plate 50 via a fastener 10. Fastener 10 may be loosened and draw clamp brackets can then be rotated about ring plate 50 until the desired angle is formed when draw clamp brackets are secured to ballast housing 11. If desired, ring plate 50 may be provided with a plurality of ring plate apertures 58 for securement of draw clamp brackets 9 to ring plate 50.

As shown in FIGS. 5 and 7, the axis through bracket walls 24 may be deemed axis A and the axis bisecting the draw clamp brackets 9 may be deemed axis B with the angle formed thereby deemed angle $\alpha$. According to one embodiment, angle $\alpha$ may be 90° during operation. If desired, any angle between 0° and 180° may also be provided as desired to suit the circumstances.

Figure 15:
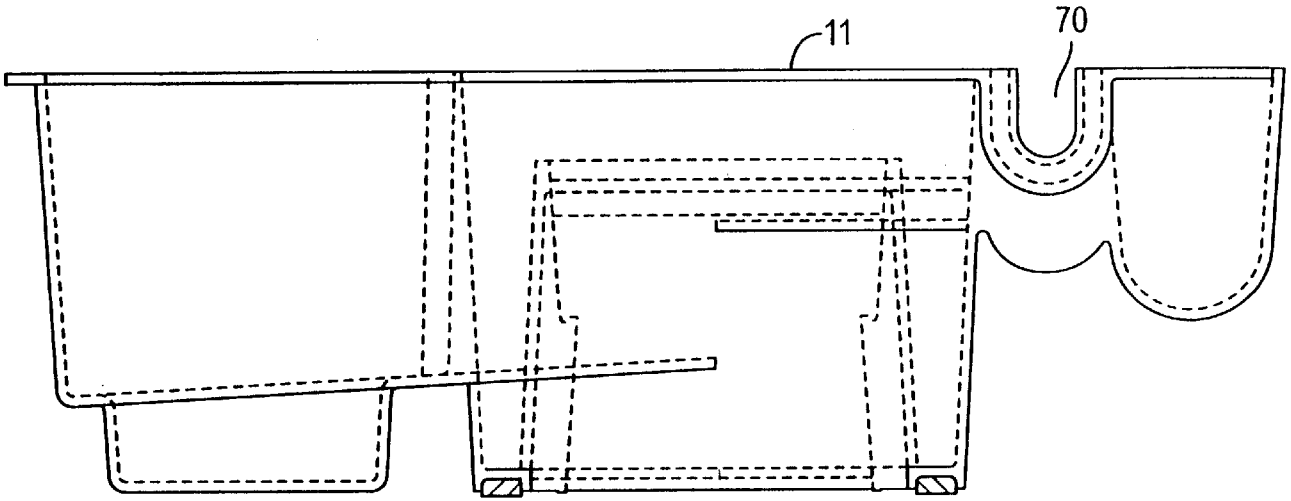
FIG. 15 is a side view of a ballast housing, including a slot for electrically connecting the components in the ballast housing according to one embodiment of the present invention.
Figure 16:
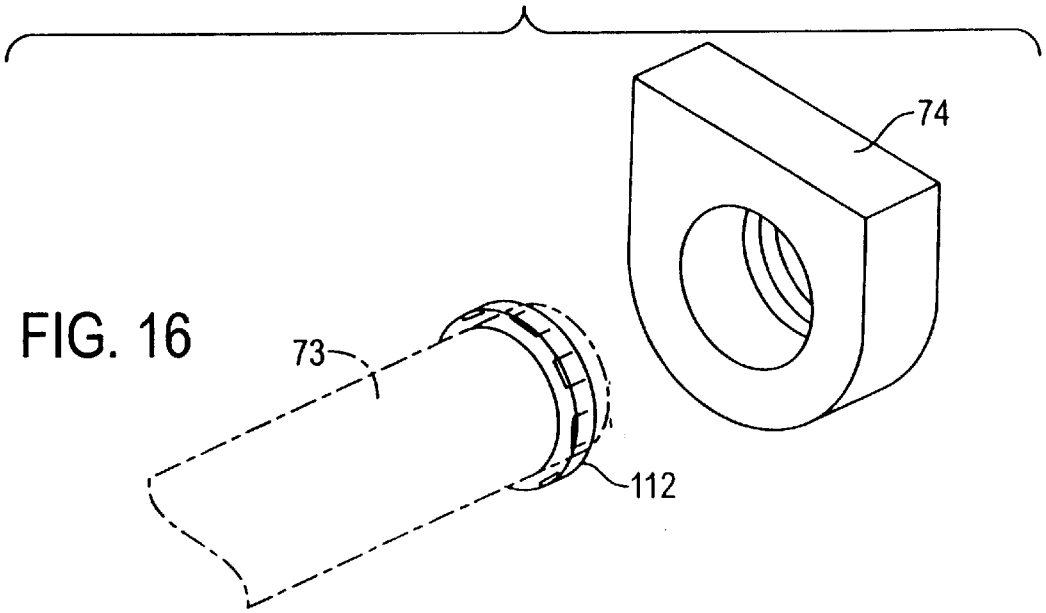
FIG. 16 is an isometric view of an electrical conduit and gasket according to one embodiment of the present invention.
Figure 17:
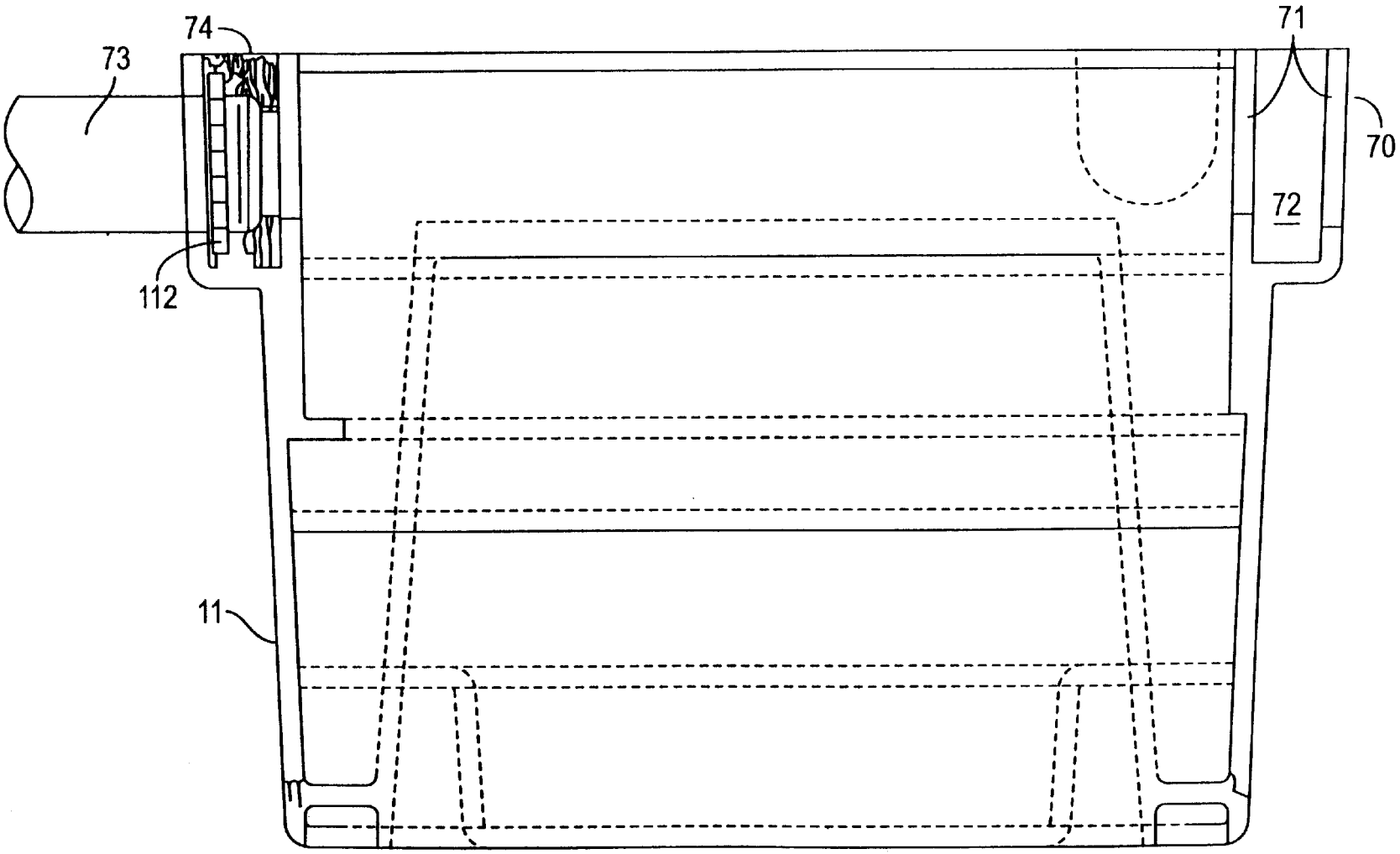
FIG. 17 is a side cut away view of a ballast housing and electrical conduit connection according to one embodiment of the present invention.

Another aspect of the present invention is the manner in which it connects the electrical conduit to the components (for example, the starter 15 and capacitor 16) in ballast housing 11. The ballast housing 11, as seen in FIGS. 15–17, may have a slot 70 for connecting the components electrically. Slot 70 may comprise a gap 72 and two slot walls 71. A conduit gasket 74 may be placed on the end of an electrical conduit 73. Electrical conduit 73 may be provided with a stopper 112 at the end. Conduit gasket 74 and electrical conduit 73 may be inserted into gap 72, such that conduit gasket 74 may be located between slot walls 71, thereby electrically connecting ballast housing 11. Top cover 17 may then be attached to ballast housing 11. Stopper 112 prevents electrical conduit 73 from pulling through slot wall 71. Conduit gasket 74 may be made of any well known gasket materials, such as rubber, plastic, foam, or the like. In one embodiment, conduit gasket 74 may be larger than gap 72 and may be made of a compressible material, such that conduit gasket 74 may be inserted into gap 72 to seal ballast housing 11, despite variances in tolerances in gap 72 of ballast housing 11. Conduit gasket 74 serves to seal the electrical connection to prevent dust, dirt, water, and the like from entering ballast housing 11. Additionally, this arrangement allows deficiencies or excesses in the length of electrical conduit 73. Also, again, tool-less assembly is permitted by this arrangement.

Figure 18:
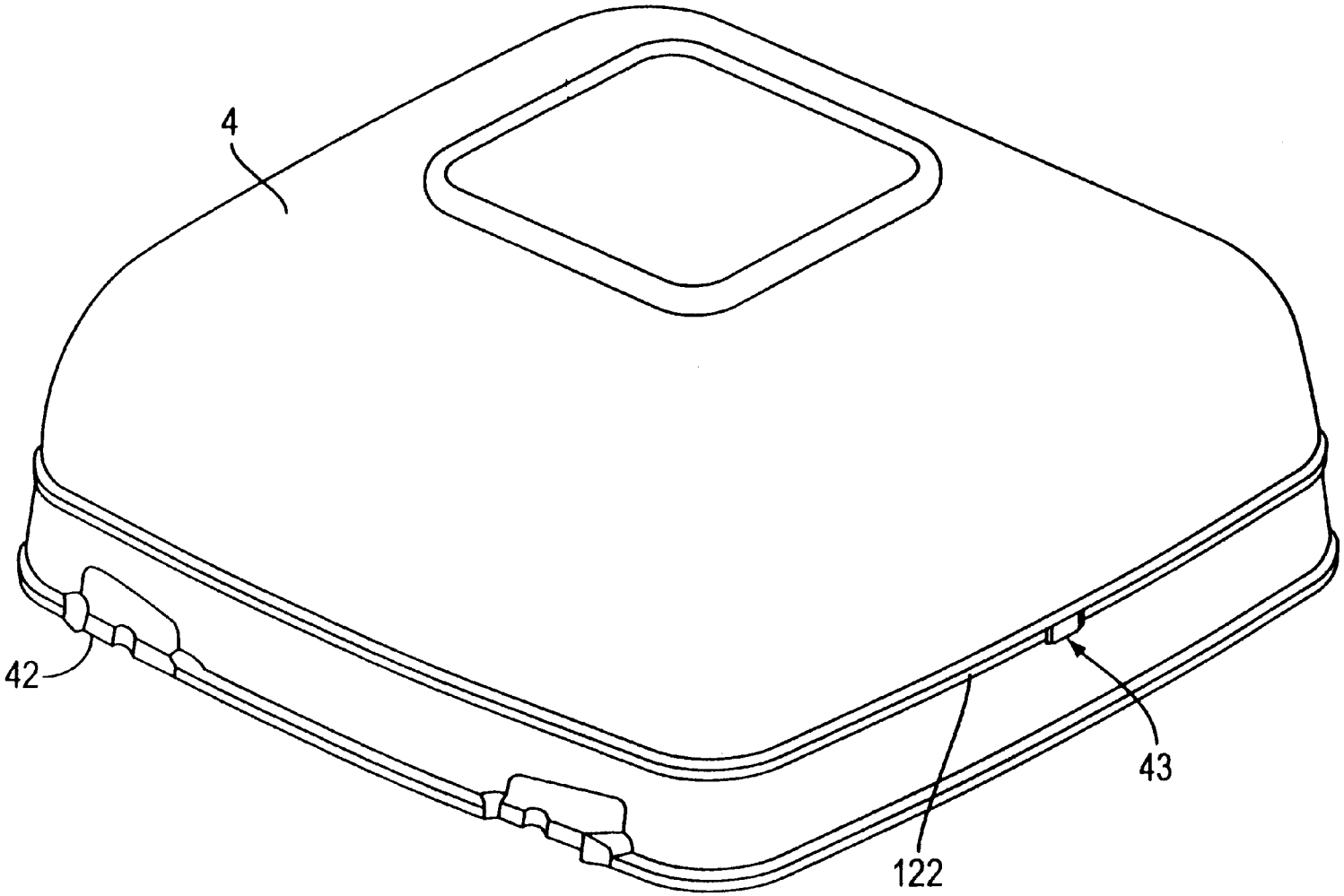
FIG. 18 is an isometric view of a canopy luminaire assembly lens according to one embodiment of the present invention.
Figure 19:
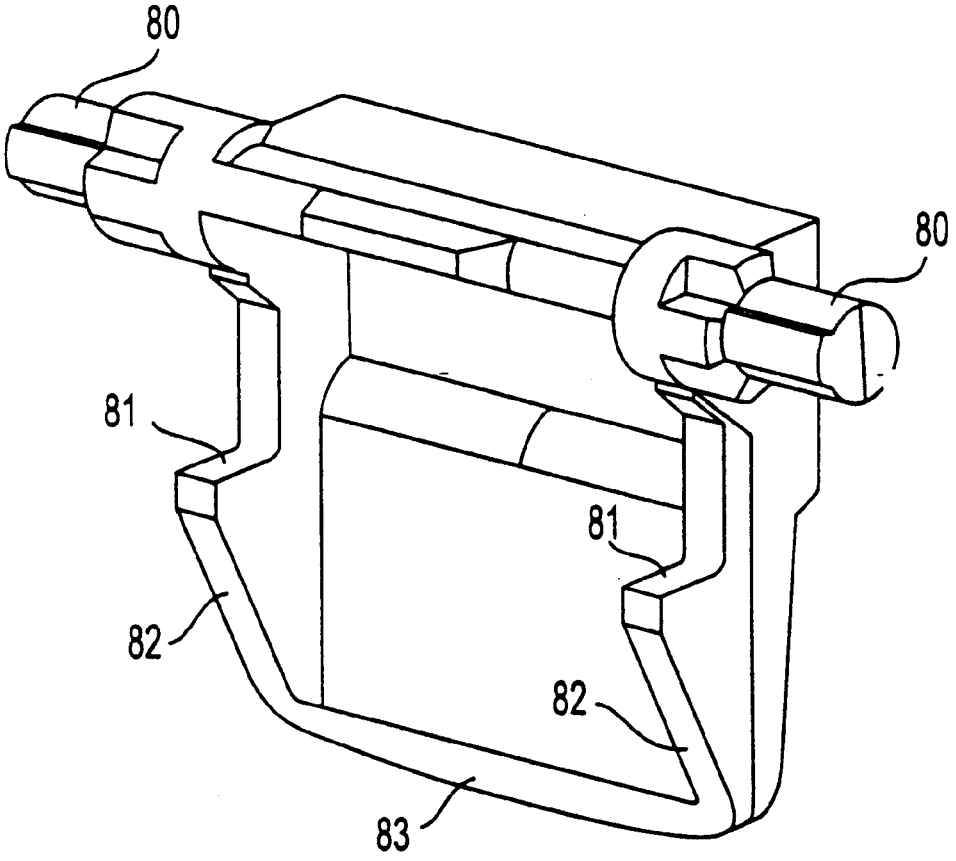
FIG. 19 is an isometric view of a latch for the canopy luminaire assembly lens according to one embodiment of the present invention.
Figure 20:
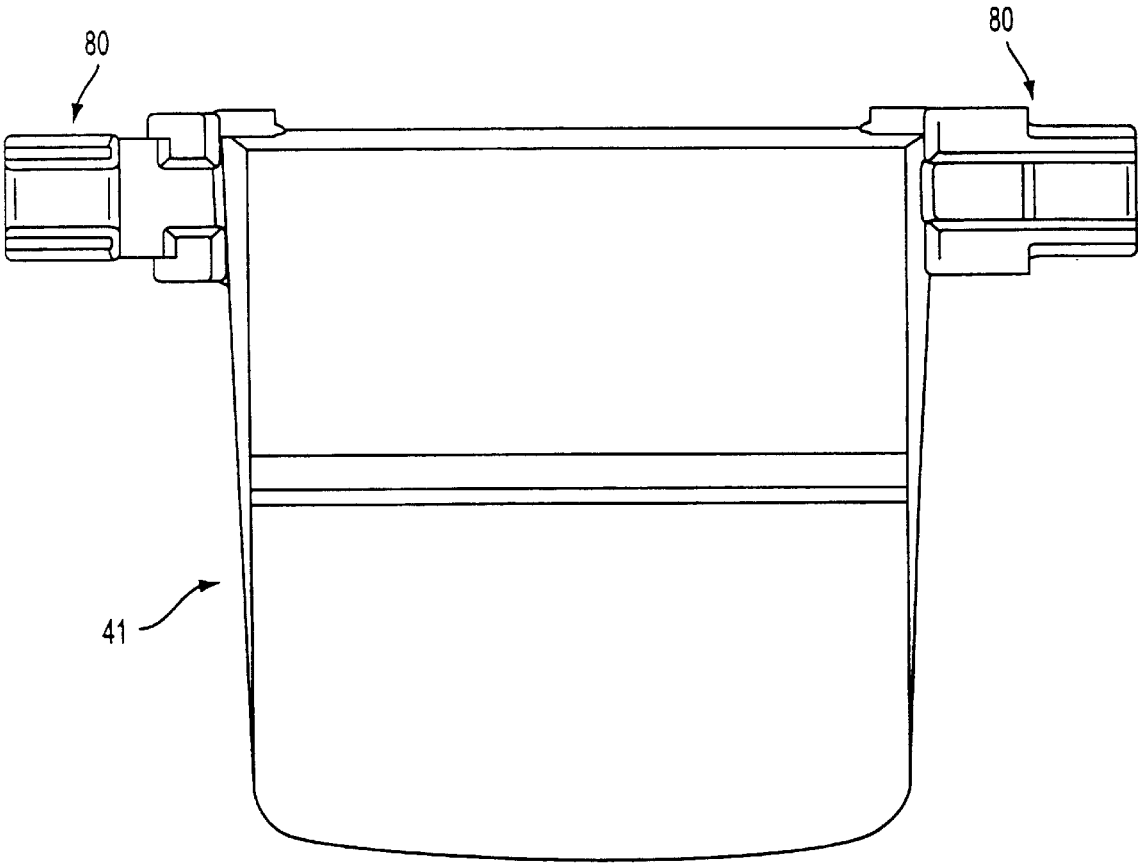
FIG. 20 is a front view of a latch for the canopy luminaire assembly lens according to one embodiment of the present invention.
Figure 21:
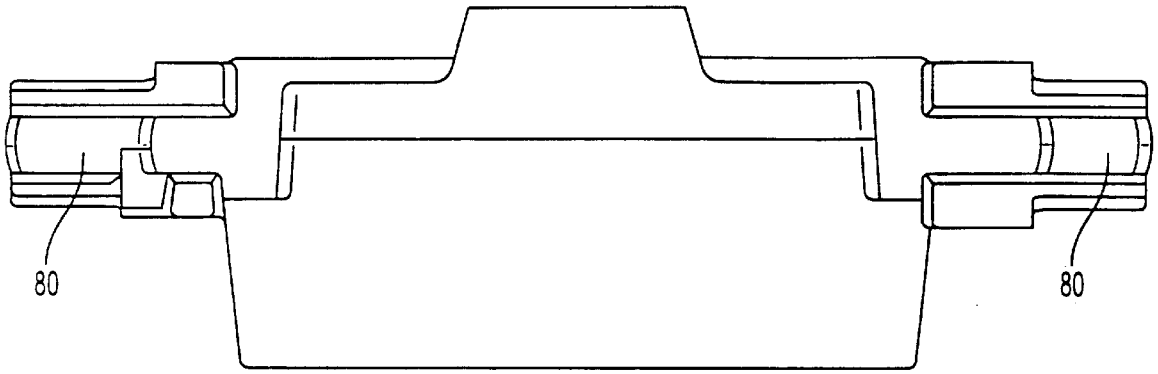
FIG. 21 is a top view of a latch f or the canopy luminaire assembly lens according to one embodiment of the present invention.
Figure 22:
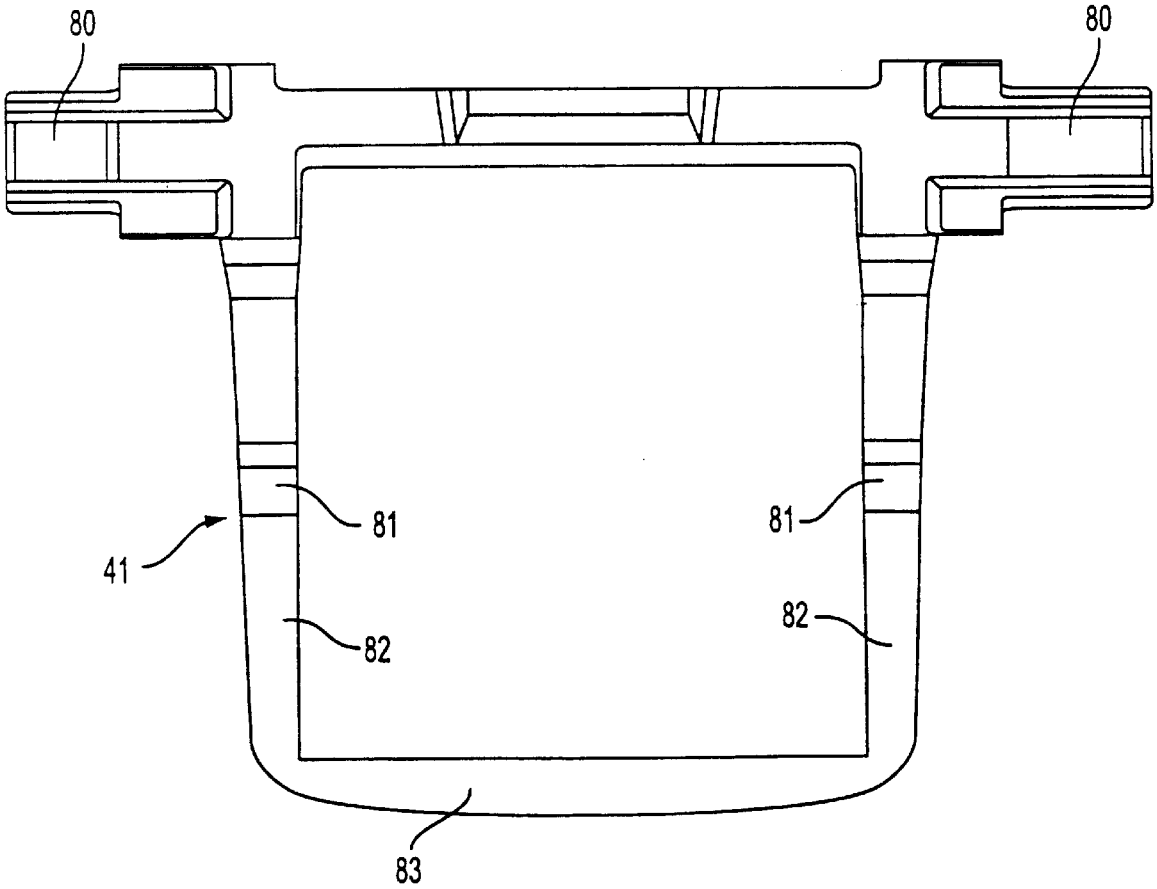
FIG. 22 is a back view of a latch for the canopy luminaire assembly lens according to one embodiment of the present invention.

Lens 4, as illustrated in FIG. 18, may have hinge bosses 42 and a latch boss 41 (FIG. 5). Both hinge bosses 42 and latch boss 41 are integral with the lens itself. Thus, in this embodiment, there is no need for additional parts to the lens, such as frames or similar parts. Thus, latch 41, and hinges 40, are attached directly to the lens 4.

One embodiment of a latch is illustrated in FIGS. 19–22. A latch 41 has swivel posts 80, and ledges 81. Swivel posts 80 may be inserted into the opening in latch boss 40 on base pan 6. Latch 41 may thus be moveable to allow latching and unlatching of lens 4. Latch 41 holds lens 4 because the edge of lens 4 rests on ledge 81. This embodiment allows a single individual to open lens 4 to change light bulb 8 by use of a pole. Slant portion 82 provides a gap between latch 41 and lens 4. A user may push up end portion 83 of latch 40 with the pole which lifts latch 40 so that lens 4 does not rest on ledges 81 and allows the user to lift 40 latch. Latch boss of lens 4 also rests on the pole, thereby allowing an individual to control opening of lens 4 to change light source 8. This embodiment allows an individual to be able to control the downward movement of lens 4 when unlatching.

Figure 23:
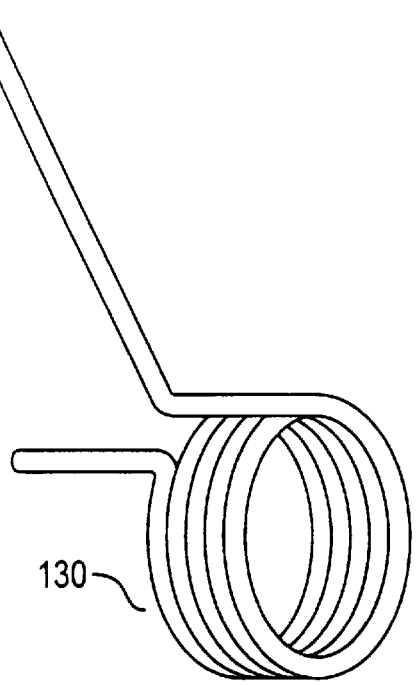
FIG. 23 is an isometric view of a spring according to one embodiment of the present invention.
Figure 24A:
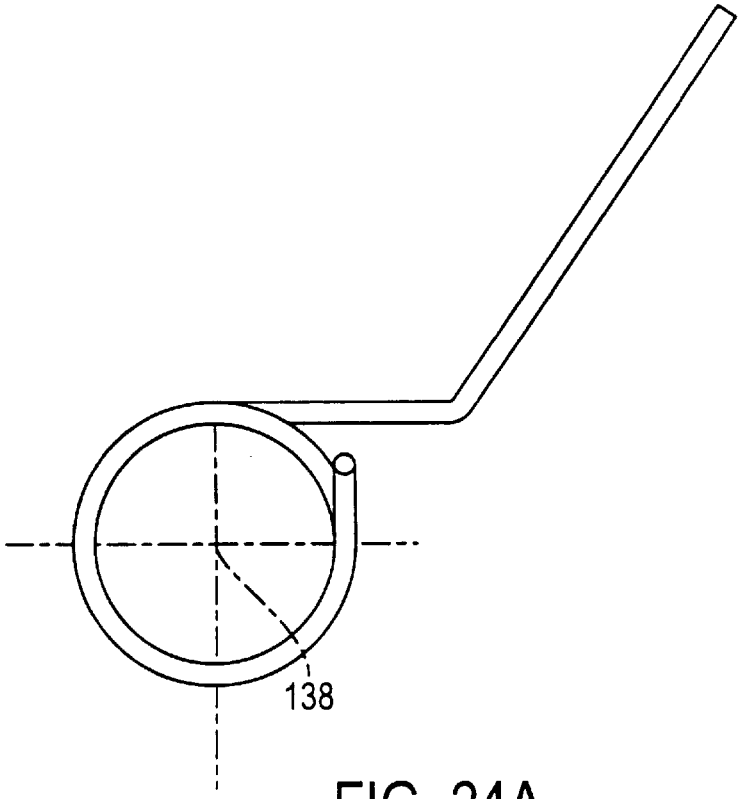
FIG. 24(*a*) is a side view of a spring according to one embodiment of the present invention.
Figure 24B:
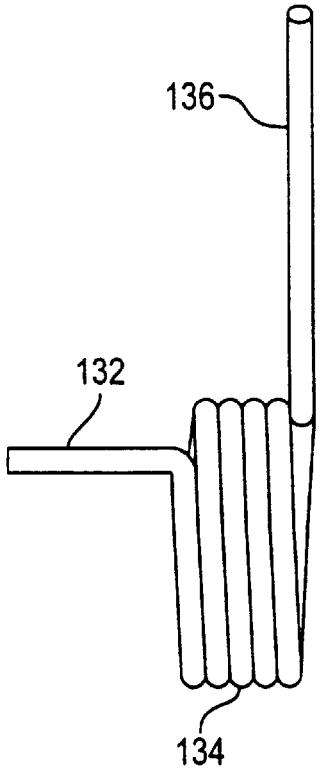

According to one embodiment of the present invention, latch 41 may be biased by a biasing mechanism such as a spring. Bias mechanism may then be arranged such that latch 41 is biased in a direction toward latching lens 4. FIGS. 23, 24(*a*), and 24(*b*) illustrate a spring 130 of one embodiment of the present invention. Spring 130 may comprise a wire including an arm 132, a coil 134, and an extension 136. In one embodiment, arm 132 may be bent substantially parallel to axis 138 of coil 134. Extension 136 may be bent so as to be substantially perpendicular to axis 138. Arm 132 may be connected to base pan 6, while extension 136 may be connected to latch 41. In this way, latch 41 may be biased in a latching fashion. Other embodiments of latch biasing may also be used.

As seen in FIG. 6, the canopy luminaire of the present invention may also be provided with a bezel 120. Bezel 120 may attach to edge portions 122 provided on lens 4 (see FIG. 18). Additionally, one or more snap bosses 43 may be provided that cooperate with bezel 120 to secure bezel 120 to lens 4. Bezel 120 may comprise a substantially narrow piece that covers the top of lens 4 and the edge of base pan 6. The top of bezel 120 thus presses against the bottom of canopy 21 during operation.

According to one embodiment, bezel 120 may have a slot provided therein along the edge that secures to the edge of lens 4 having latch 41. The slot may permit latch 41 to be able to connect to the bottom of the upper rim of lens 4 so that latch 41 can secure lens 4 to base pan 6. According to one embodiment, latch 40 and bezel 120 may be made of the same or similar looking material so that they match.

Bezel 120 may be made of glass filled polyester, for example. Bezel 120 may be made out of material having strength and contraction qualities so as to withstand a wide range of temperatures. In one embodiment of the present invention, bezel 120 may be made of a fifteen percent glass filled polyester. Other materials may also be used.

Figure 25A:
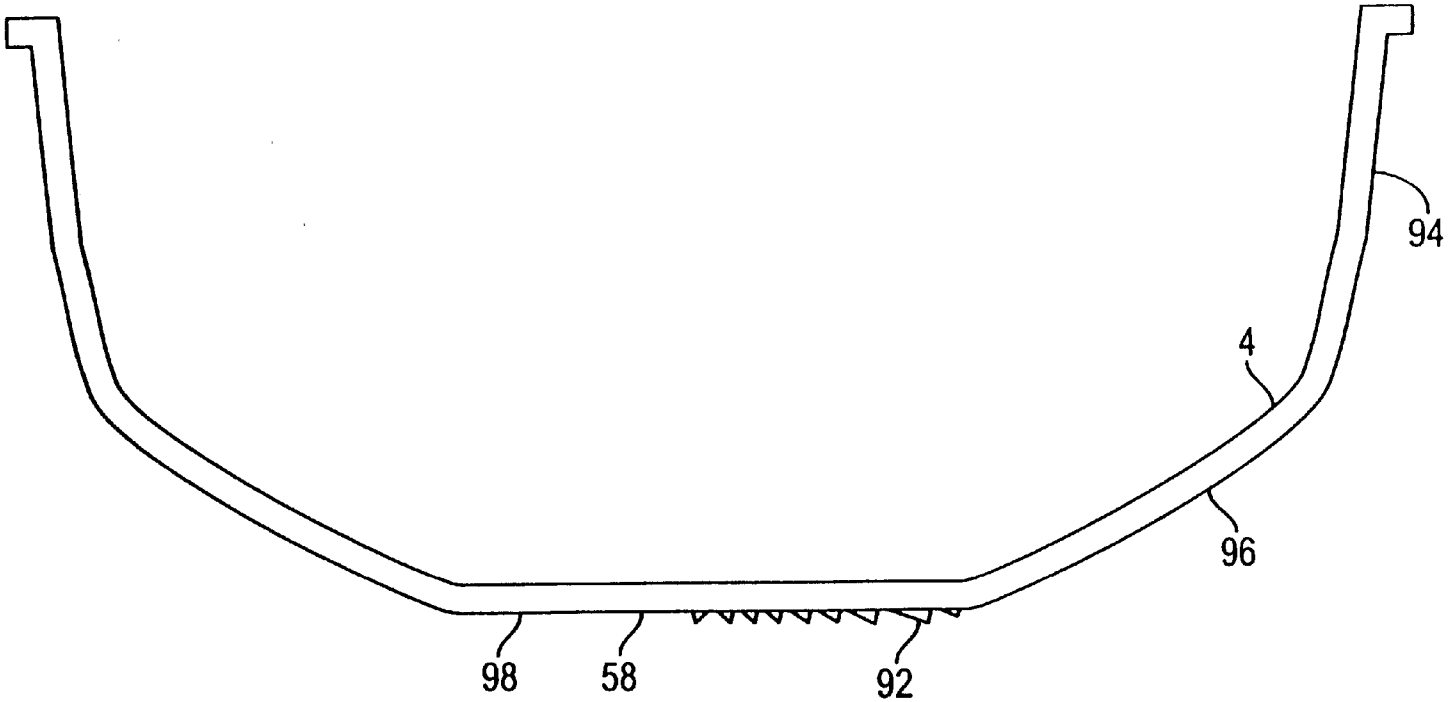
FIG. 25 is a side cut away view of a canopy luminaire lens according to one embodiment of the present invention.
Figure 25B:
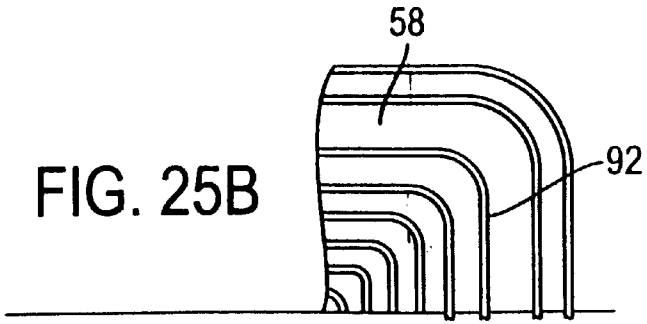
Figure 26:
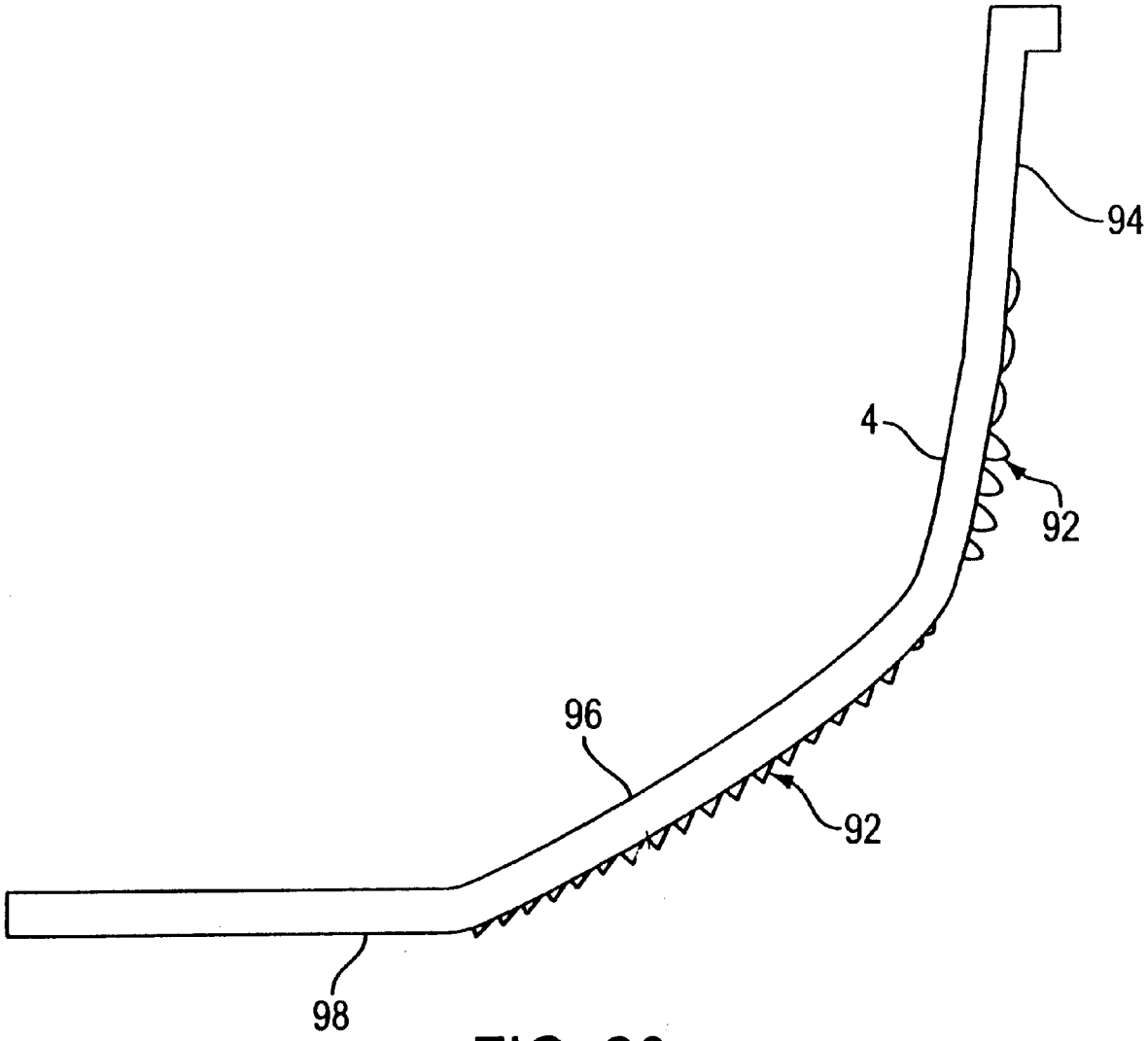
FIG. 26 is a side cut away of view of a canopy luminaire lens according to another embodiment of the present invention.

In one embodiment of the present invention, lens 4 of lower portion 2 may be made from a translucent material, for example glass, plastic, or similar material. The surface of lens 4 may be of a variety of different shapes and contours. In one embodiment (FIGS. 25 and 25(*b*)), lens 4 may have a side surface 94, a diagonal surface 96, and a bottom surface 98. Ridges 92 may be located on bottom surface 98 to allow improved defraction of light from light source 8. Ridges 92 may be spaced at various intervals on bottom surface 98. In one embodiment, the cross section of ridges 92 may be triangular in shape. However, the cross section of ridges 92 may also be of other shapes. In one embodiment of the present invention, ridges 92 may be located on side surface 94, as shown in FIG. 26. Ridges may also be located on diagonal surface 96. It will be well known to one of ordinary skill in the art to design ridges 92 on lens 4 to optimize the light defraction and emission form lens 4. For example, ridges 92 may be of various sizes and shapes, as well as located in varying densities on lens 4.

Lens 4 may be attached directly to hinge 40. In one embodiment of the present invention, hinge 40 may comprise (FIG. 27) a base pan hinge portion 40*a* and a lens hinge portion 40*b*. Base pan lens portion 40*a* may include a hinge clamp 140, and a clamp clip 150, which may be retained by a hinge retainer 160 to lens 4. For example, hinge clip 140 (FIGS. 37–40) may comprise a flat portion 142, having a retainer portion 143 with a retainer hole 149, tabs 144, and an angled portion 146 having a clamp hole 148. Angled portion 146 of hinge clip 140 may be at any angle between 0° and 90°.

Figure 42:
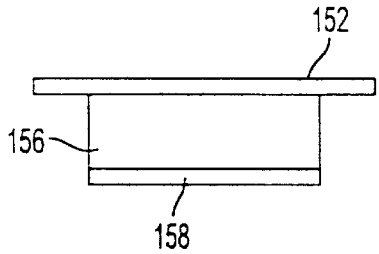
FIG. 42 is a top view of a clamp clip according to an embodiment of the present invention.
Figure 43:
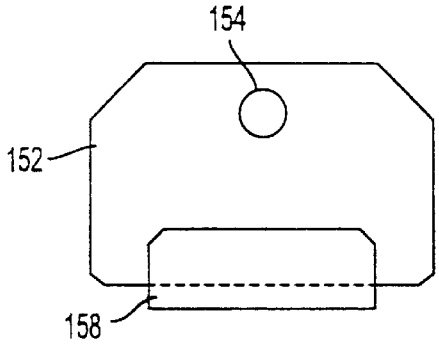
FIG. 43 is a front view of a clamp clip according to an embodiment of the present invention.
Figure 44:
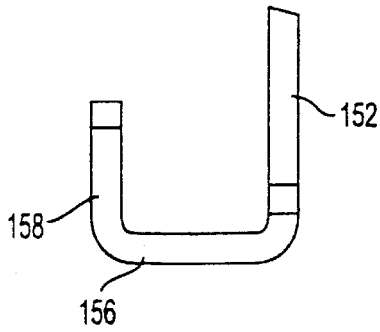
FIG. 44 is a side view of a clamp clip according to an embodiment of the present invention.

Clamp clip 150 (FIGS. 42–44) may comprise a base portion 152 having a retainer hole 154, an edge portion 156, and a lip portion 158. In one embodiment of the present invention, edge portion 156 is substantially perpendicular to base portion 152, and lip portion 158 is substantially parallel to and partially overlapping base portion 152.

Figure 45:
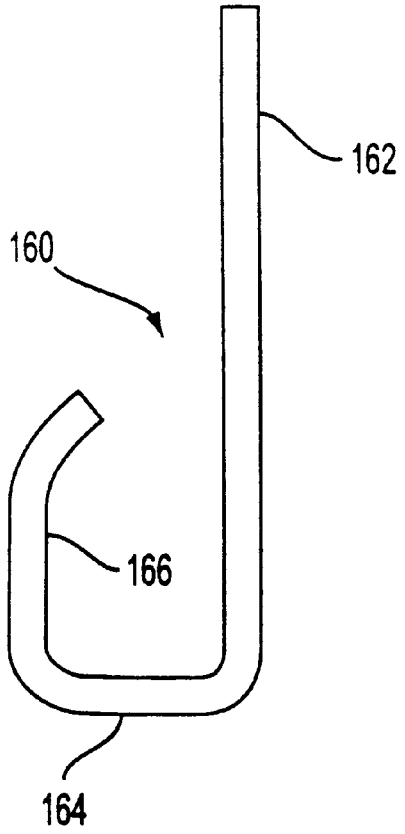
FIG. 45 is a front view of a hinge retainer according to an embodiment of the present invention.
Figure 46:
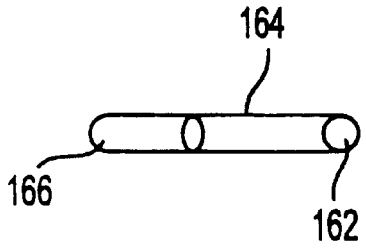
FIG. 46 is a side view of a hinge retainer according to an embodiment of the present invention.
Figure 47:
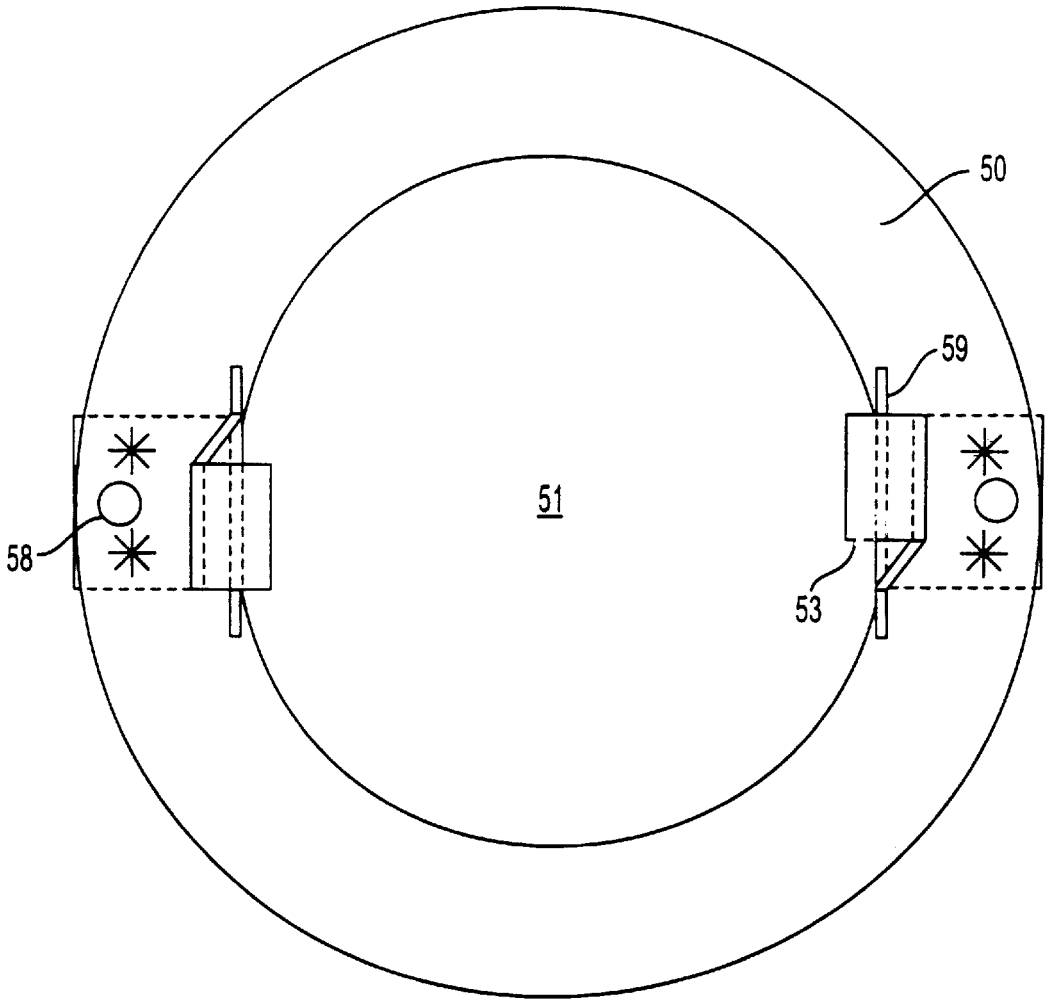
FIG. 47 depicts a top view of a draw clamp bracket according to another embodiment of the present invention.
Figure 48:
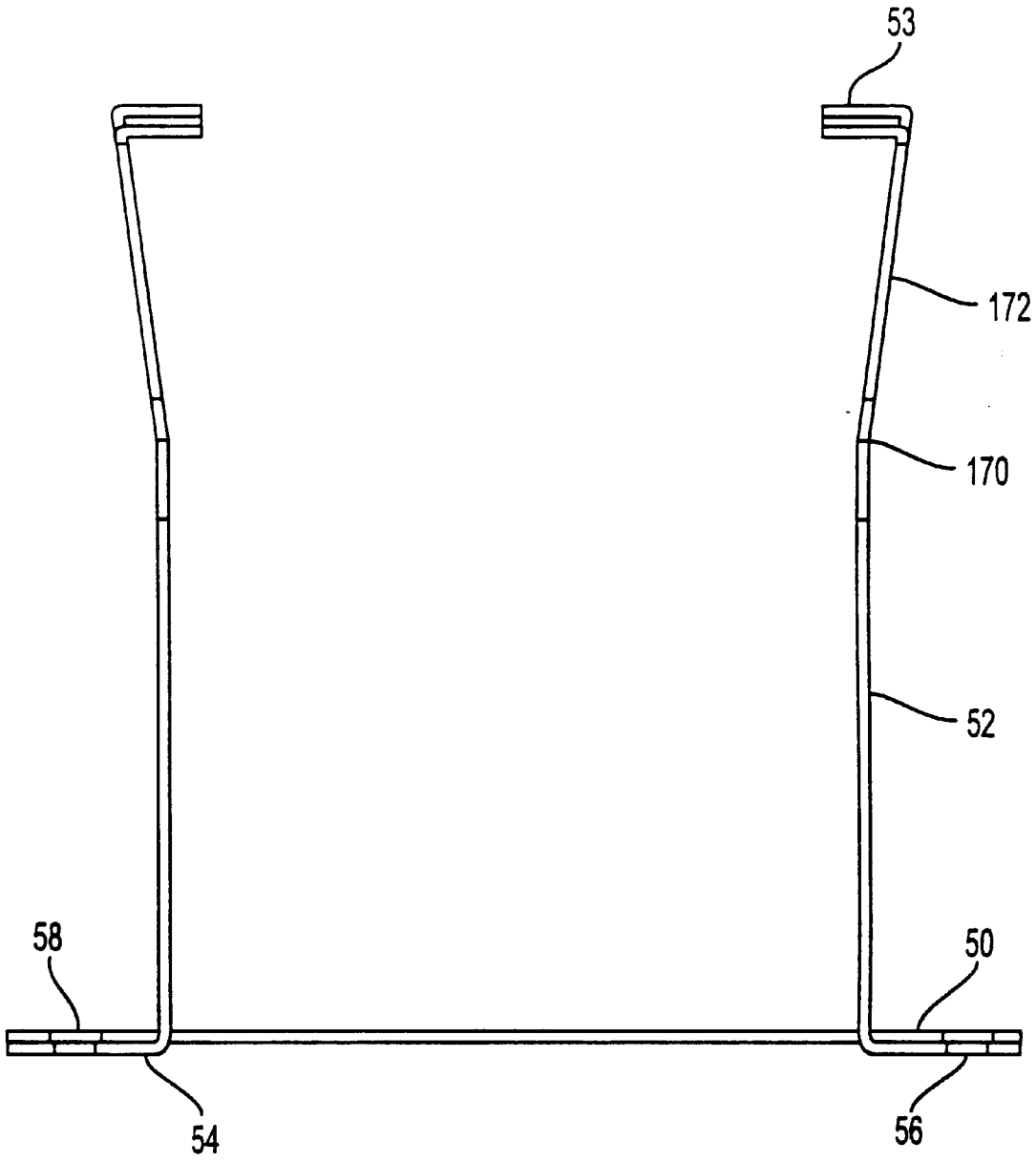
FIG. 48 depicts a side view of a draw clamp bracket according to another embodiment of the present invention.

Hinge retainer 160 (FIGS. 45–46) may comprise a wire having a straight portion 162, a bent portion 164, and a bowed portion 166. In one embodiment, bent portion 164 may be substantially perpendicular to straight portion 162, while bowed portion 166 may be substantially parallel to and partially overlapping straight portion 162.

Figure 27:
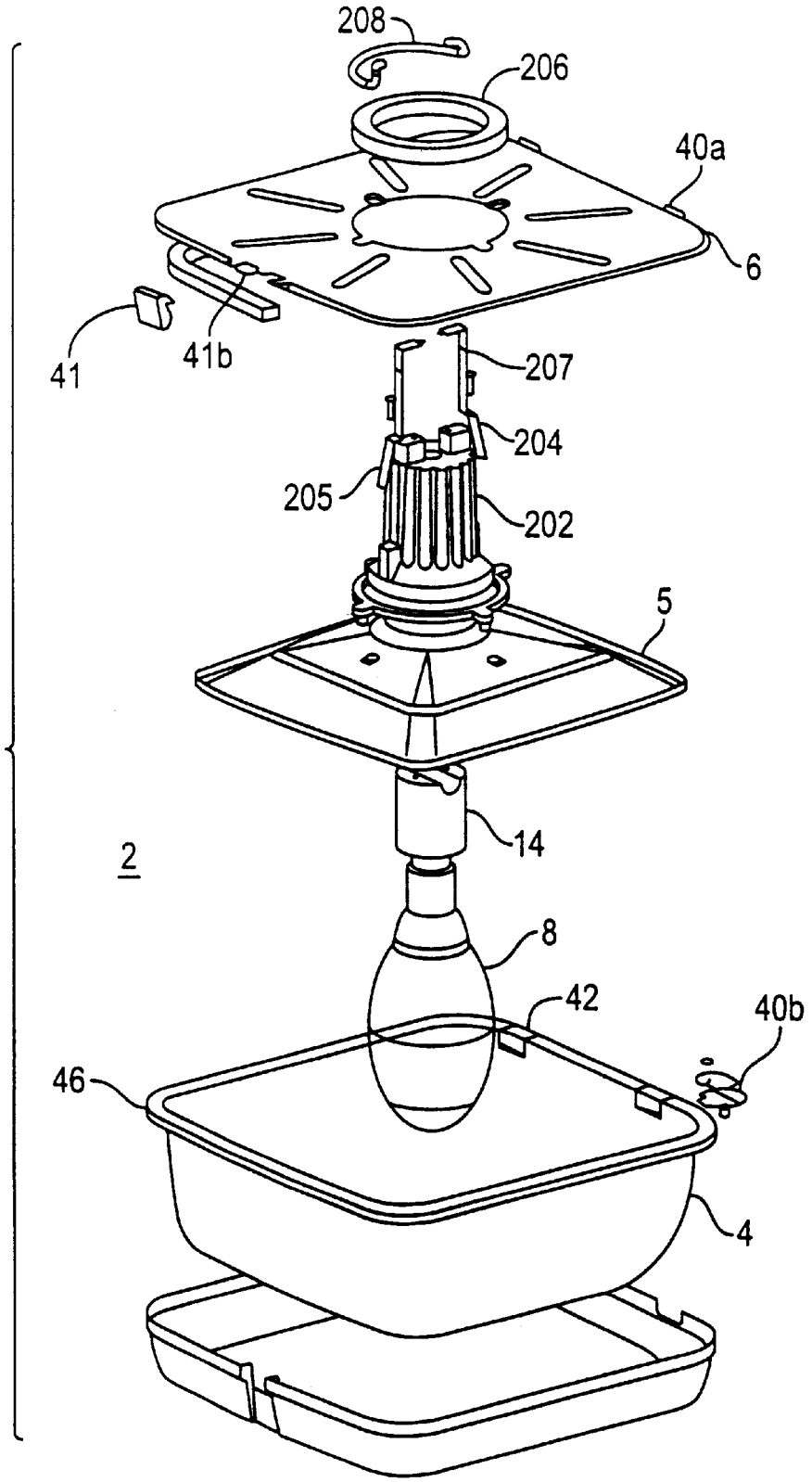
FIG. 27 depicts a luminaire according to another embodiment of the present invention.

As illustrated in FIG. 27 in relation to hinge 40*b*, retainer portion 143 of hinge clip 140 may be inserted into an aperture on the side of lens 4. Tabs 144 may then rest against the side of lens 4. Clamp clip 150 may be inserted onto lip 46 of lens 4, such that the upper edge lens 4 abuts the lower face of base portion 152, the outer side of lens lip 46 abuts edge portion 156, and the lower edge of lens lip 46 abuts lip portion 158. In this arrangement, clamp retainer hole 154 may substantially align with retainer hole 149 of hinge clip 140. Hinge clamp 140 and clamp clip 150 may then be attached to lens 4 by inserting straight portion 162 of hinge retainer 160 through clamp retainer hole 154 and retainer hole 149. Base pan hinge portion 40*a* may then be inserted into hinge hole 148, thereby allowing lens 4 to be moveable with respect to base pan 6. Lens hinge portion 40*b* may be made of a material of sufficient strength to support lens 4. In one embodiment, hinge clip 140 and clamp clip 150 may be made of type 304 stainless steel, while hinge retainer 160 may be made of stainless steel wire. Other materials may also be used. Other embodiments may also be used for hinge 40.

According to another embodiment of the present invention, it may be desirable to place the lamp socket 14 in lower portion 2. FIGS. 27–30 depict another embodiment in which lamp socket 14 is disposed within lower portion 2 of the luminaire assembly. According to this embodiment, it may be desirable to provide a lamp socket housing 202 that may be attached to the reflector 5 and sized to receive lamp socket 14 therein. Lamp socket housing 202 may be comprised of metal, such as stainless steel or aluminum, and may be attached to reflector 5 by screws or other attachment mechanisms of the like.

Figure 28:
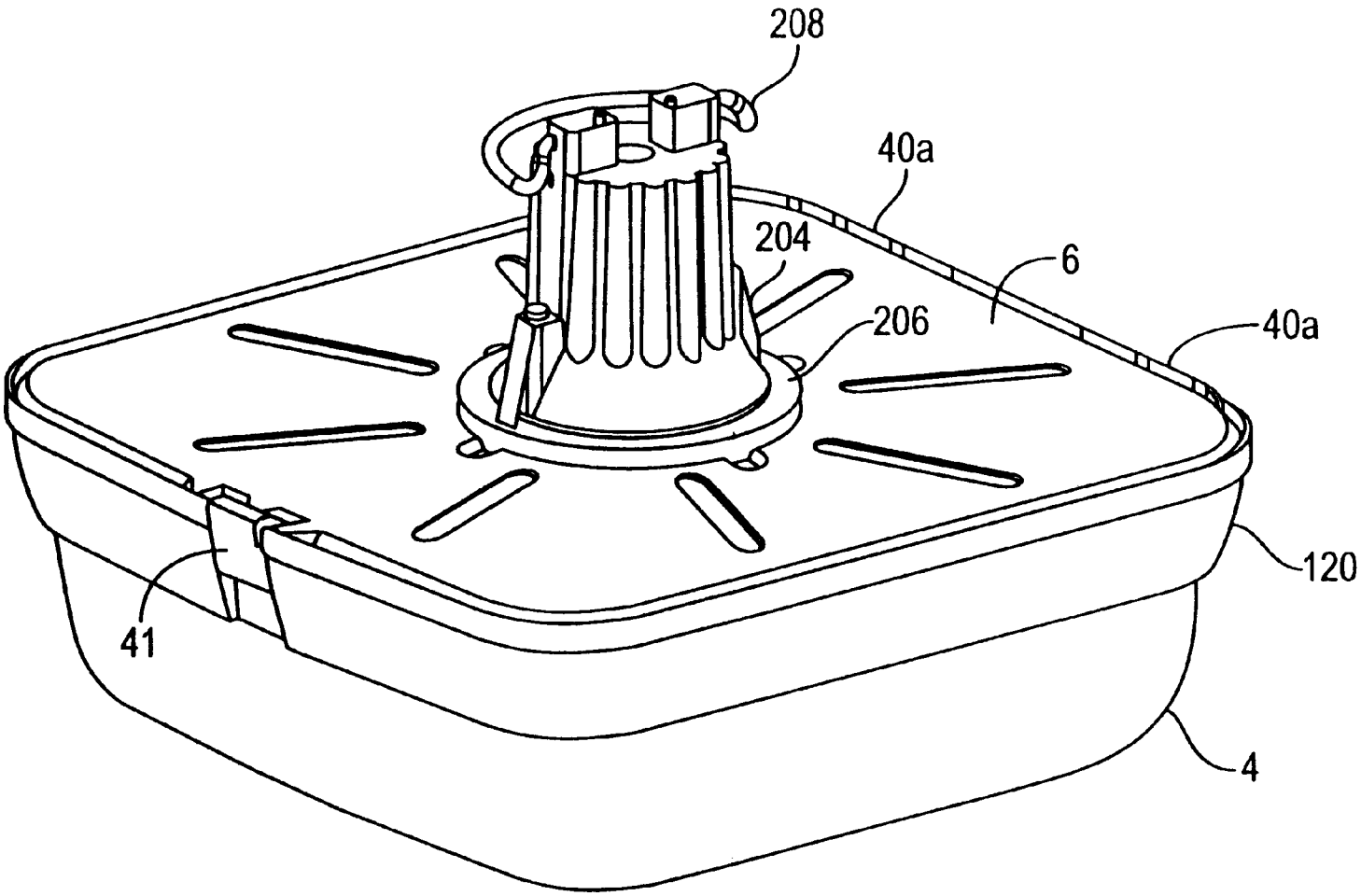
FIG. 28 depicts a perspective view of a luminaire according to another embodiment of the present invention.
Figure 30:
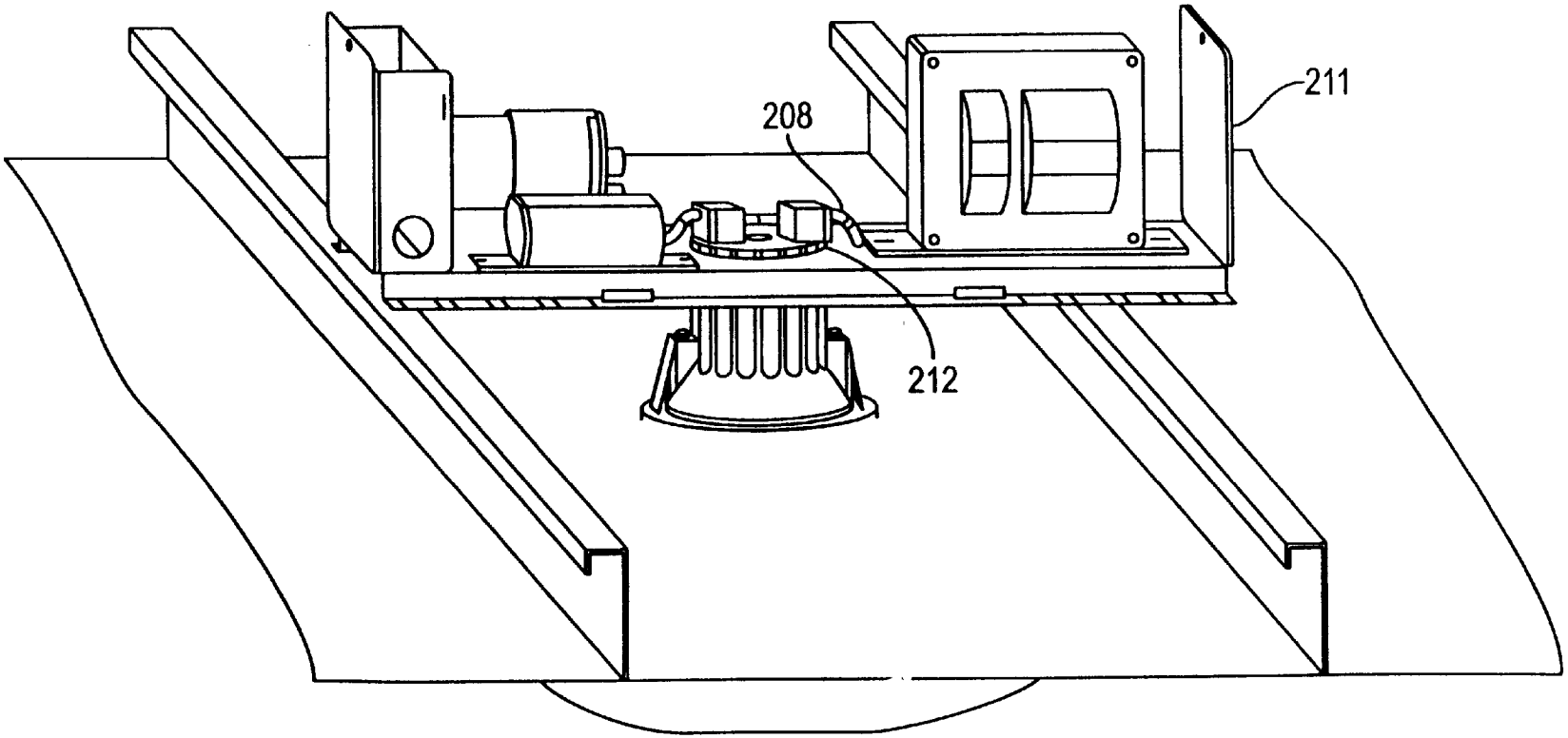
FIG. 30 depicts a perspective view of an assembled luminaire assembly according to another embodiment of the present invention.
Figure 31:
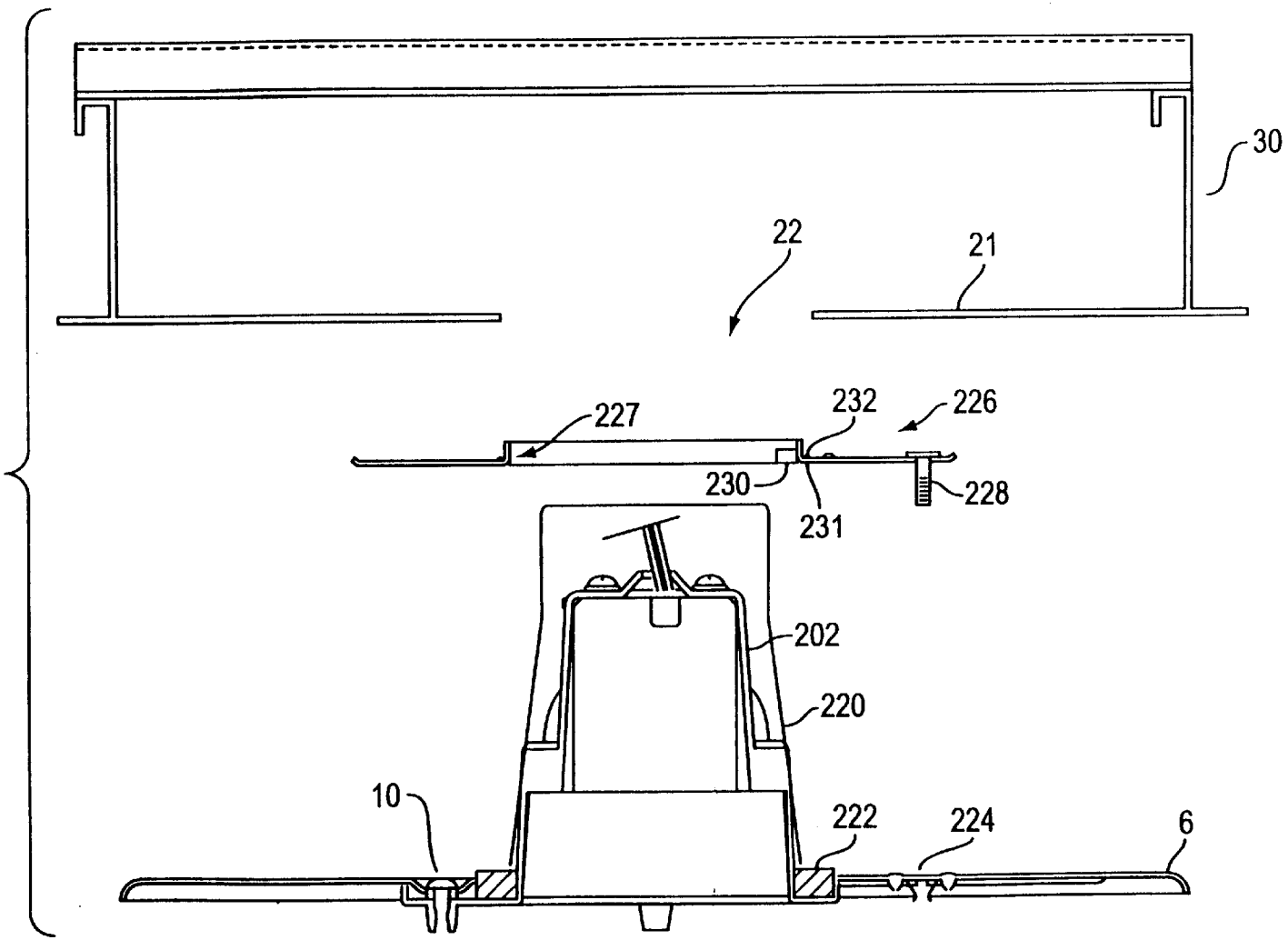
FIG. 31 depicts a side cut-away view of a luminaire assembly according to another embodiment of the present invention.
Figure 32:
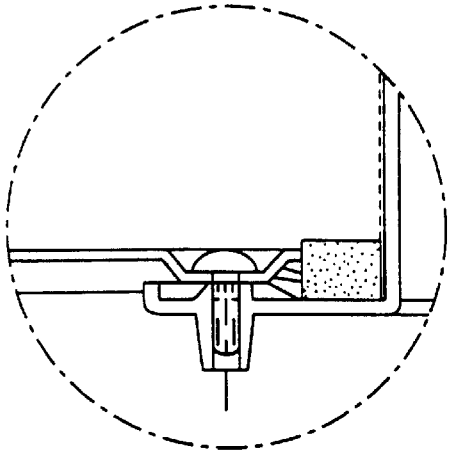
FIG. 32 depicts a partial cross-sectional view of a portion of the luminaire assembly of FIG. 31.

According to this embodiment, brackets 204 may be attached to lamp socket housing 202 for securement of lower portion 2 to the ballast box disposed above the canopy. Brackets 204 may be attached on the top portion of lamp socket housing 202 and may be provided with outwardly extending portions 205 whose function is described in detail below. In this embodiment, a gasket 206 may be provided. It also may be desirable to place the entire ballast box on the ribs. Additionally, brackets 204 may be provided with a plurality of apertures 207 disposed in the top portion of the bracket. These apertures may be sized to receive the inwardly protruding ends of a bail 208 as depicted in FIGS. 27 and 28. Bail 208 may be used to secure brackets 204 to the ballast box as shown in FIG. 30.

Figure 29:
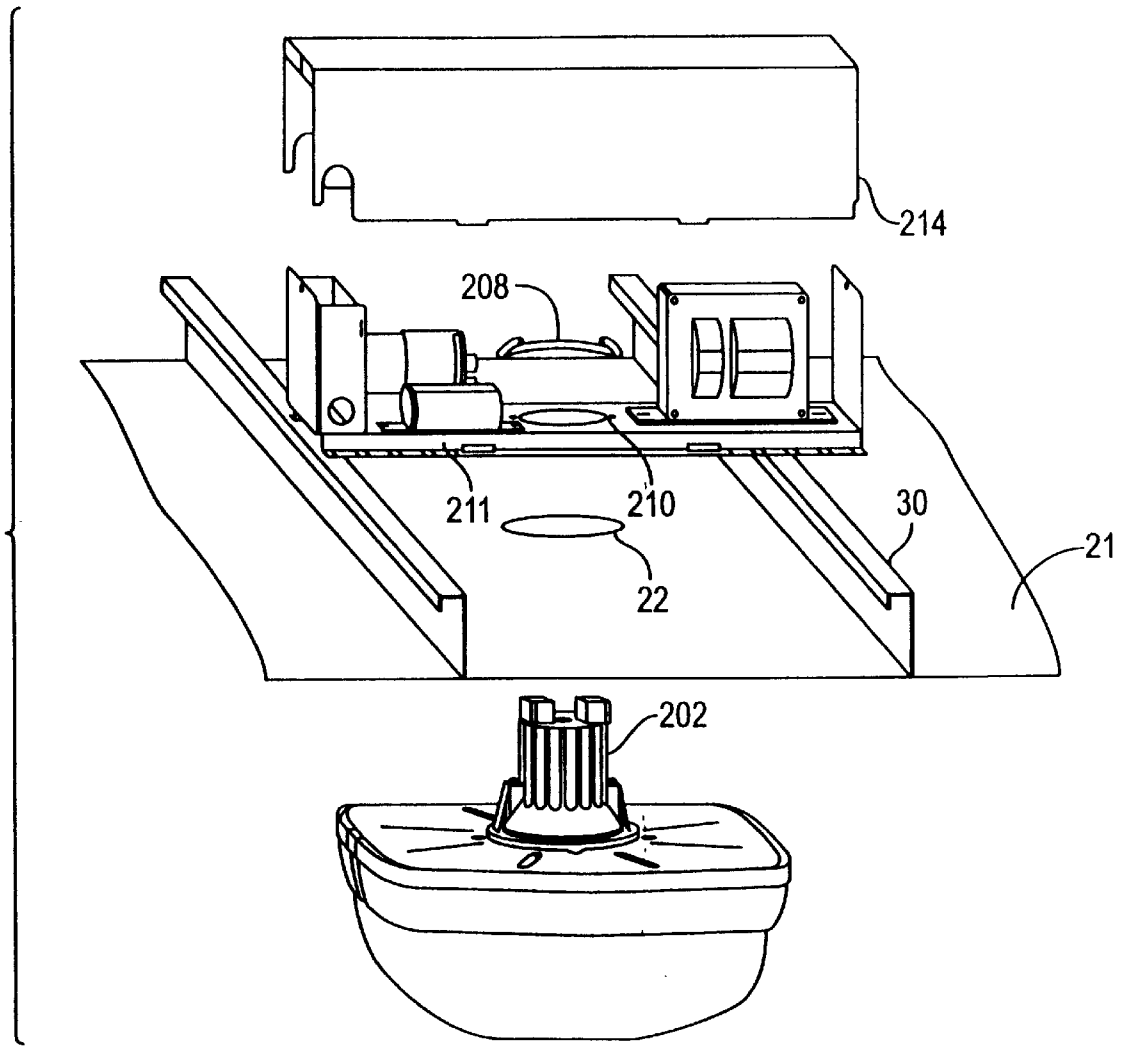
FIG. 29 depicts a perspective view of a luminaire assembly according to another embodiment of the present invention.

Accordingly, as shown in FIG. 29, the luminaire assembly according to this embodiment may be assembled by inserting lower portion 2 up through canopy aperture 22. As lamp socket housing 202 is inserted through the aperture, the outwardly extending portions 205 are deflected toward lamp socket housing 202. When lamp socket housing 202 is inserted above aperture 22 sufficiently, outwardly extending portions 205 return to their outward position beyond the circumference of aperture 22. These portions 205 may then rest directly on top of the canopy 21 and support the weight of lower portion 2.

Next, lower ballast housing 211 may be positioned on ribs 30 of canopy 21. Lower ballast housing 211 may be provided with a capacitor, ballast, and other electrical components as described above with respect to FIGS. 1–26. Lower ballast housing 211 may be provided with an aperture 210 disposed in the bottom of that housing. Lower ballast housing 211 is placed such that lamp socket housing 202 fits through aperture 210 so that the top of lamp socket housing 202 is disposed above lower ballast housing 211. Additionally, brackets 204 may be disposed above lower ballast housing 211 as well.

To secure lower portion 2 to lower ballast housing 211, bail 208 may be secured to brackets 204 above lower ballast housing 211. Because bail 208 is wider than aperture 210, bail 208 rests on the top of lower ballast housing 210, as shown in FIG. 30. Then, as shown in FIG. 29, upper ballast housing 214 may be placed over the components of lower ballast housing 21 1 and attached to prevent moisture from entering the ballast thus formed.

This embodiment operates in the same manner as the embodiments disclosed above with latch 41 permitting access to the interior of lower portion 2 and hinges 40 allowing lens 4 to open to access light source 8.

Figure 33:
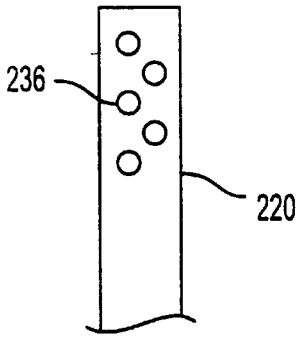
FIG. 33 depicts a partial side view of a bail bracket according to an embodiment of the present invention.
Figure 34:
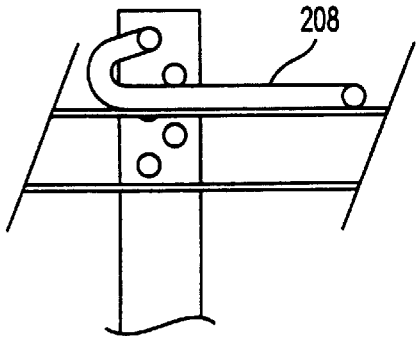
FIG. 34 depicts a partial side view of a bail and bail bracket assembly according to an embodiment of the present invention.

Accordingly to yet another embodiment of the present invention, another mechanism for securing lower portion 2 to canopy 21 may be provided, as depicted with respect to FIGS. 31–36. According to this embodiment, a lamp socket housing 202 may be provided. Also, it may be desired to place lamp socket 14 in the ballast box portion and therefore, lamp socket housing 202 may not be provided. In either case, a bail bracket 220 may be provided. FIG. 33 depicts a side view of bail bracket 220 which is provided with a plurality of apertures 236 for receiving a bail 208 as described in detail below. Bail bracket 220 may extend down below base pan 6 and be connected via fasteners 10 to the underside of base pan 6.

Base pan 6 may be provided with one or more grooves 224. Grooves 224 may comprise two or more inwardly projecting pieces that are biased. These pieces may be deflected outwardly to receive a cylindrical piece, such as a screw. Because they are biased, the pieces tighten on the received piece to form a securing mechanism.

According to this embodiment, a mounting bracket 226 may be provided. Mounting bracket 226 may comprise a metal piece that is relatively flat with an upwardly opening portion 227. Upwardly opening portion 227 may be sized to fit in canopy aperture 22. Mounting bracket 226 may also comprise one or more screws 228 extending downwardly from the mounting bracket for cooperation with grooves 224 on base pan 6 as described in detail below. Mounting bracket 226 may also comprise one or more mounting clips 230. Mounting clips 230 may comprise a lower portion 231 with an opening to receive an attaching component 234. The opening permits mounting clips 230 to slip toward the center of upwardly opening portion 227 and back in toward attaching component 234. Mounting clip 230 also comprises an outwardly projecting portion 232 that extends up from lower potion 231 a distance sufficient to receive canopy 21 between lower portion 231 and outwardly projecting portion 232.

Figure 35:
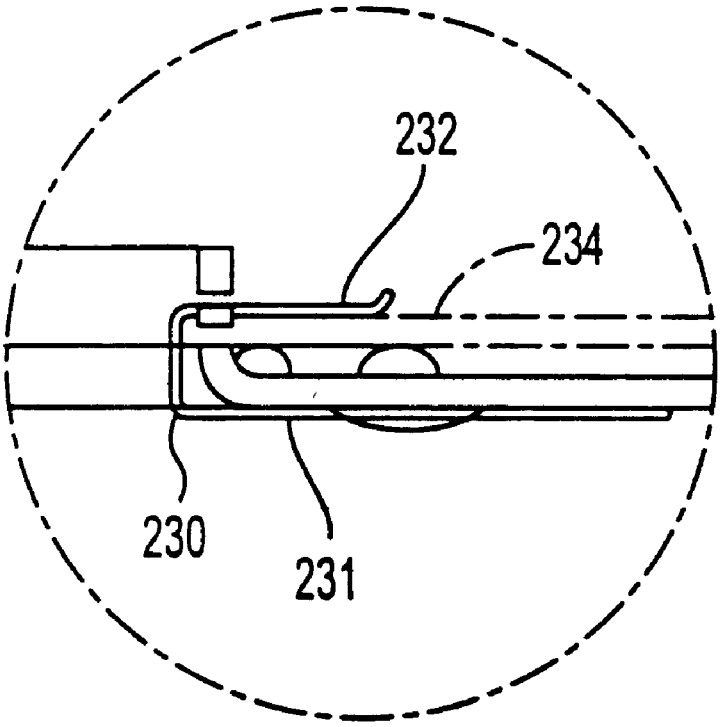
FIG. 35 depicts a partial cross-section view of a mounting clip assembly according to an embodiment of the present invention.
Figure 36:
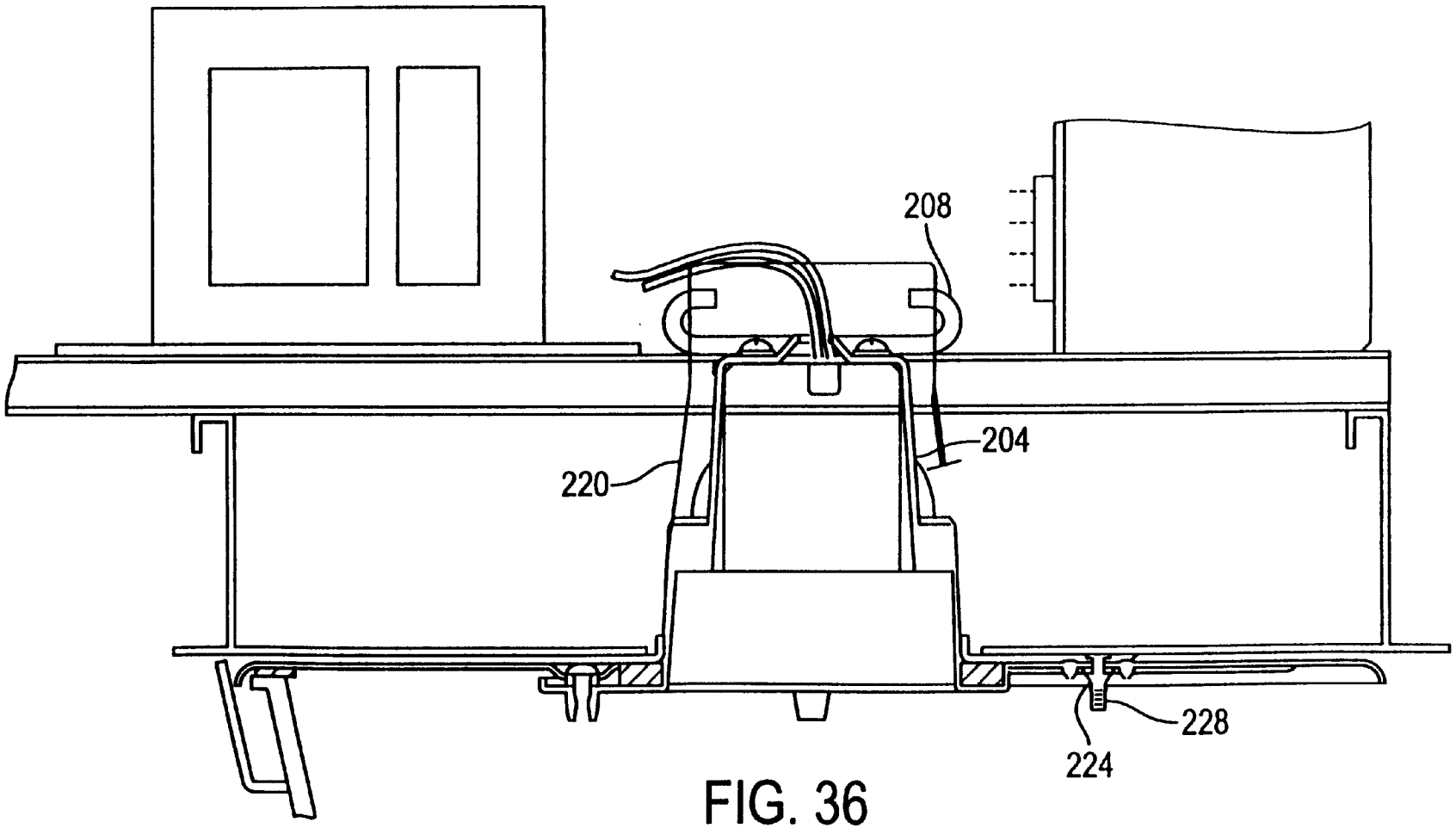
FIG. 36 depicts a perspective view of an assembled luminaire assembly according to an embodiment of the present invention.
Figure 37:
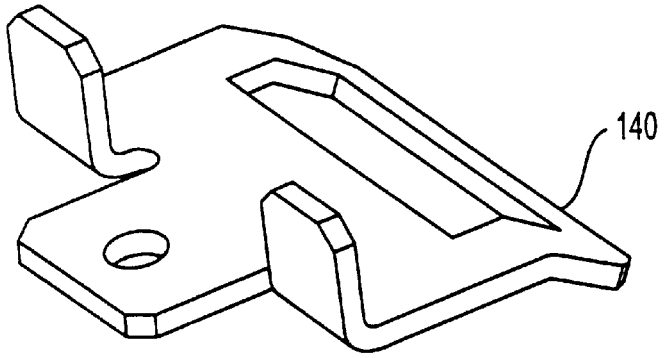
FIG. 37 depicts an isometric view of a hinge clip according to an embodiment of the present invention.
Figure 38:
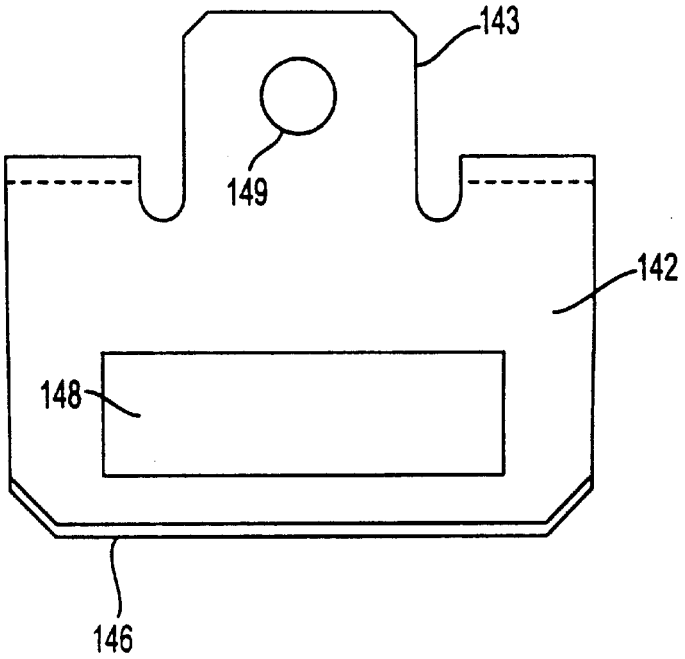
FIG. 38 depicts a bottom view of a hinge clip according to an embodiment of the present invention.
Figure 39:
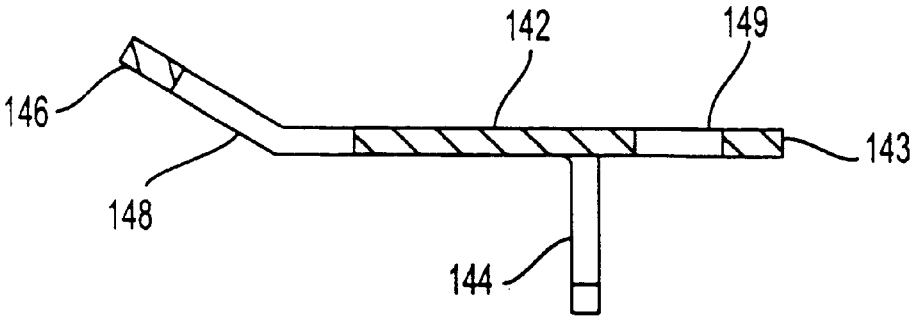
FIG. 39 depicts a side view of a hinge clip according to an embodiment of the present invention.
Figure 40:
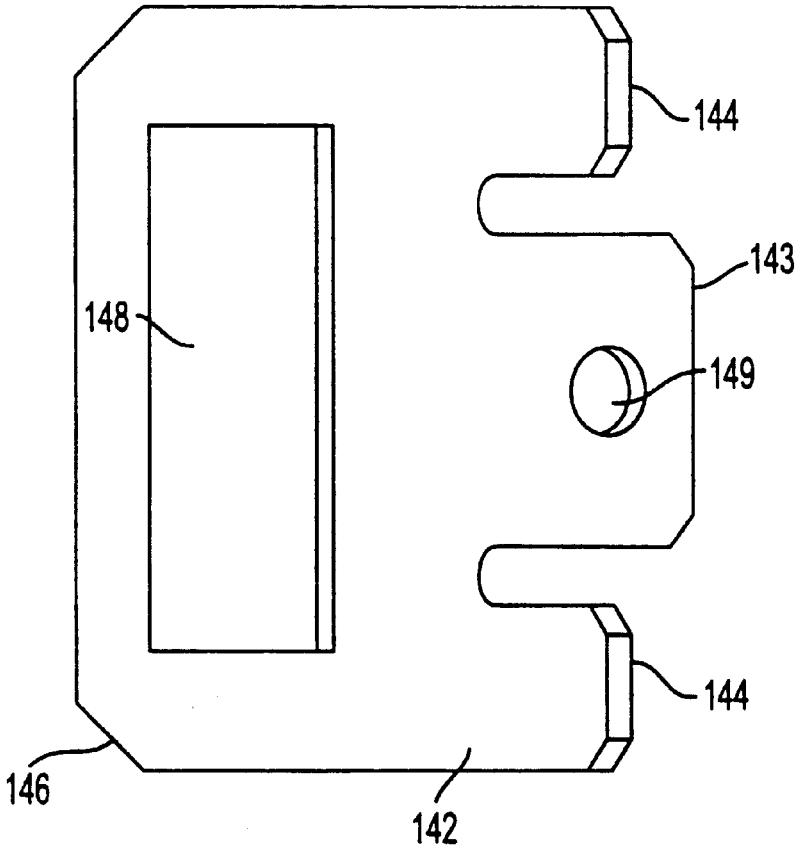
FIG. 40 depicts a top view of a hinge clip according to an embodiment of the present invention.
Figure 41:
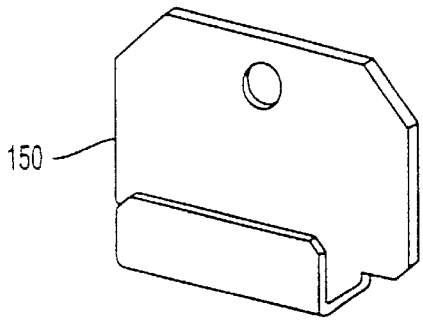
FIG. 41 depicts an isometric view of a hinge retainer according to an embodiment of the present invention.

This embodiment may be installed as follows. First, mounting bracket 226 may be attached to canopy 21 by placing upwardly opening portion 227 through canopy aperture 22. Mounting clip 230 is positioned such that outwardly projecting portion 232 is inward of canopy aperture 22. Once upwardly opening portion 227 is placed such that mounting bracket 226 fits against the bottom of canopy 21, mounting clip 230 is engaged with canopy 21 by moving mounting clip 230 toward attachment component 234, as illustrated in FIG. 35. Outwardly projecting portion 232 is thereby outside of the circumference of canopy aperture 22 and thereby the mounting bracket 226 is secured to canopy 21.

Then, bail bracket 220 of lower portion 22 is inserted up through upwardly opening portion 227. Screws 228 are aligned with grooves 224 so that when lower portion 2 is inserted up through mounting bracket 226 and canopy aperture 22, screws 28 engage with grooves 224 to thereby secure mounting bracket 226 to lower portion 2 so that lower portion 2 is thereby secured to canopy 2 1.

To secure lower portion 2 further, the ballast housing may be placed over bail bracket 220 and bail 208 may be engaged to bail bracket 220. The weight of lower portion 2 may thereby be supported by bail 208 resting on the ballast housing.

In addition, it should be recognized that any combination of elements from FIGS. 1–50 may be used. For example, instead of locking cam 19, bail 208 may be used in the embodiment of FIGS. 1–26 by providing draw clamp brackets 9 with apertures to receive bail 208. Also, instead of lamp socket housing 202 being provided in lower portion 2 as shown in FIGS. 27–35, lamp socket 14 may be disposed in a ballast box above the canopy and a bracket may be used extending from base pan 6 through canopy aperture 22. That bracket may be provided with outwardly extending portions 205 to hold lower portion 2 above the canopy.

Further, instead of upper and lower ballast housing 210 and 214, ballast box 11 may be used with the lower portion 2 of FIGS. 27–36. That ballast box may be provided with deck supports 33 as discussed in detail above. Accordingly, it should be recognized that any combination of elements disclosed in the detailed description herein may be used as would be understood by one of ordinary skill in the art without departing from the scope of the present invention.

Other embodiments and uses of the invention will be apparent to those skilled in the art from consideration of the specification and practice of the invention disclosed herein. The specification and examples should be considered exemplary only. The scope of the invention is only limited by the claims appended hereto.

What is claimed is:

1. A luminaire assembly for use on a canopy comprising:

a lower portion disposed below the canopy for receiving a light emitting source;

an upper housing disposed above the canopy having disposed therein a ballast and a lamp socket, the light emitting source from the lower portion extending up through an aperture in the canopy and connecting to the lamp socket in the upper housing; and an attachment mechanism attaching the lower portion to the upper housing through the aperture in the canopy so that the upper housing supports the lower portion.

2. The luminaire assembly of claim 1 wherein the upper housing is a die cast housing.

3. The luminaire assembly of claim 1 wherein the lower portion comprises a base and a lens connected to the base pan to cover the light emitting source.

4. The luminaire assembly of claim 1 wherein the attachment mechanism comprises a draw clamp bracket that attached to the upper housing.

5. The luminaire assembly of claim 4 further comprising a securement mechanism that secures the attachment mechanism to the upper housing.

6. The luminaire assembly of claim 1 wherein the canopy comprises a plurality of rib portions and deck portions disposed between the rib portions and further comprising one or more supports extending from the upper housing onto the rib portions to support the upper housing and lower housing on the ribs of the canopy.

7. The luminaire assembly of claim 1 wherein the canopy comprises a plurality of rib portions and deck portions disposed between the rib portions and the upper housing rests solely on the deck portions.

8. A luminaire assembly for use on a canopy comprising:

a lower portion for receiving a light emitting source, the lower portion being disposed below the canopy;

an upper housing disposed above the canopy comprising an aperture disposed in the bottom portion formed by walls on the interior of the upper housing, the walls having a receiving portion for receiving a bracket portion; and a bracket connected to the lower portion attachment mechanism for attaching the lower portion to the upper housing, the bracket having a portion that cooperates with the receiving portion in the upper housing to secure the bracket to the walls of the upper housing.

9. The luminaire assembly of claim 8 wherein the bracket comprises a draw clamp bracket.

10. The luminaire assembly of claim 8 wherein the receiving portion comprises a notch and the bracket portion comprises a winged extending portion.

11. The luminaire assembly of claim 8 wherein the bracket further comprises a platform at the upper end of the bracket and further comprising a locking cam secured to the platform to secure the bracket to the upper housing.

12. A luminaire assembly for use on a canopy comprising:

a lower portion for receiving a light emitting source, the lower portion being disposed below the canopy;

an upper housing disposed above the canopy comprising an aperture disposed in the bottom portion of the upper housing; and a bracket connected to the lower portion attachment mechanism for attaching the lower portion to the upper housing, the bracket extending from the lower housing up through an aperture in the canopy and through the aperture disposed in the bottom portion of the upper housing; and a securement mechanism connected to the bracket having an outer diameter greater than the diameter of the aperture in the upper housing to support the lower portion to the upper housing.

13. The luminaire housing of claim 12 wherein the securement mechanism comprises a locking cam.

14. The luminaire housing of claim 12 wherein the bracket comprises a platform and the securement mechanism comprises a locking cam wherein the locking cam comprises an indent for receiving the platform and a plurality of teeth for engaging the locking cam to the platform.

15. A luminaire assembly comprising:

a lower portion disposed below the canopy for receiving a light emitting source;

an upper housing disposed above the canopy;

an attachment mechanism attaching the lower portion to the upper housing through the aperture in the canopy so that the upper housing supports the lower portion; and wherein the position that the attachment mechanism is secured to the lower housing may be moved so that the orientation between the lower portion and the upper housing may be altered.

16. The luminaire assembly of claim 15 wherein the lower portion comprises a ring plate, wherein the attachment mechanism is secured to the ring plate of the lower portion, and wherein the attachment mechanisms may be rotated about the ring plate to place them in the desired position.

17. A method of assembling a canopy luminaire assembly comprising the steps of:

forming an opening in the canopy;

resting an upper housing above the canopy having disposed therein a ballast and a lamp socket, a light emitting source extending from the lamp socket through the opening in the canopy;

attaching a lower portion of the canopy luminaire around the light emitting source against the canopy with an attachment mechanism that extends from the lower portion around the light emitting source through the opening and connects the lower portion to the upper housing so that the upper housing supports the lower portion.

18. The method of claim 17 wherein the canopy comprises a plurality of rib portions and deck portions disposed between the rib portions and further comprising the steps of providing one or more supports extending from the upper housing onto the rib portions and supporting the upper housing and lower housing on the ribs of the canopy.

19. The method of claim 17 further comprising the step of securing the attachment mechanism to the upper housing with a securement mechanism.

20. The method of claim 17 further comprising the steps of rotating the attachment mechanism to provide relative movement in the orientation of the lower portion and the upper housing.

* * * * *

UNITED STATES PATENT AND TRADEMARK OFFICE

CERTIFICATE OF CORRECTION

PATENT NO. : 6,264,344 B1
DATED : July 24, 2001
INVENTOR(S) : Quiogue et al.

It is certified that error appears in the above-identified patent and that said Letters Patent is hereby corrected as shown below:

Column 17,
Line 26, delete "the" and insert -- a --.
Line 31, delete "the" and insert -- a --.
Line 49, delete "the", first occurrence, and insert -- a --.
Line 51, delete "the" and insert -- a --.
Line 53, delete "housing", second occurrence, and insert -- portion --.

Column 18,
Line 17, delete "the", second occurrence, and insert -- a --.
Line 20, delete "housing" and insert -- portion --.
Line 26, delete "mechanisms" and insert -- mechanism --.
Line 27, delete "them" and insert -- it --.
Line 27, delete "the", second occurrence, and insert -- a --.

Signed and Sealed this

Seventh Day of May, 2002

*Attest:*

*Attesting Officer*

JAMES E. ROGAN
*Director of the United States Patent and Trademark Office*